US008382537B2

(12) United States Patent
Kinoshita

(10) Patent No.: US 8,382,537 B2
(45) Date of Patent: Feb. 26, 2013

(54) MARINE VESSEL WITH CONTROLLED REVERSE DRIVE MODE

(75) Inventor: Yoshimasa Kinoshita, Shizuoka (JP)

(73) Assignee: Yamaha Hatsudoki Kabushiki Kaisha, Shizouka (JP)

( * ) Notice: Subject to any disclaimer, the term of this patent is extended or adjusted under 35 U.S.C. 154(b) by 282 days.

(21) Appl. No.: 12/885,652

(22) Filed: Sep. 20, 2010

(65) Prior Publication Data

US 2011/0223815 A1 Sep. 15, 2011

(30) Foreign Application Priority Data

Mar. 15, 2010 (JP) ..... 2010-058036

(51) Int. Cl.
*B63H 21/21* (2006.01)

(52) U.S. Cl. ..... 440/1; 440/41

(58) Field of Classification Search ..... 440/1, 84, 440/87, 41; 701/21
See application file for complete search history.

(56) References Cited

U.S. PATENT DOCUMENTS 7,399,210 B2 * 7/2008 Yoshimasa ..... 440/1
2004/0266286 A1 12/2004 Yoshimasa

* cited by examiner

*Primary Examiner* — Edwin Swinehart
(74) *Attorney, Agent, or Firm* — Keating & Bennett, LLP

(57) ABSTRACT

A marine vessel includes a hull and a jet propulsion device arranged to take in water through an intake port and eject the water through an ejection port rearward with respect to the hull. The ejection port is arranged posterior to the intake port. The marine vessel also includes a reversing member arranged to be movable between a forward drive position and a reverse drive position. The reversing member is arranged to, when placed at the reverse drive position, reverse the direction of the water ejected from the jet propulsion device forward with respect to the hull (in a direction capable of generating a propulsive force in the reverse drive direction). The marine vessel further includes an operation unit arranged to be operated by a marine vessel maneuvering operator to locate the reversing member at the forward drive position or the reverse drive position, and an internal combustion engine arranged to drive the jet propulsion device. The marine vessel also includes a control unit arranged and programmed to operate in a reverse drive mode in which when the reversing member is located at the reverse drive position by the operation unit, and such that the control unit controls the internal combustion engine to operate within a predetermined speed range.

5 Claims, 17 Drawing Sheets

MARINE VESSEL WITH CONTROLLED REVERSE DRIVE MODE

BACKGROUND OF THE INVENTION

1. Field of the Invention

The present invention relates to a marine vessel including a jet propulsion device arranged to be driven by an internal combustion engine.

2. Description of Related Art

Jet propulsion devices are arranged to be driven by an engine to take in water around the hull through an intake port and eject the water through an ejection port. The reactive force of the ejected water provides a propulsive force to the hull. The ejection port is arranged to eject water rearward with respect to the hull. Such jet propulsion devices further include a reverse bucket. The reverse bucket is arranged to reverse the direction of water (water flow) ejected through the ejection port forward with respect to the hull. When the hull drives forward, the reverse bucket is held at a forward drive position so as not to cover the ejection port. When the hull drives backward, the reverse bucket is arranged at a reverse drive position so as to cover the ejection port. The reverse bucket is arranged to be moved between the forward and reverse drive positions in response to the operation of a lever arranged at an operator's seat.

One related art pertaining to a marine vessel including such a jet propulsion device is disclosed in U.S. Patent Application Publication No. 2004/0266286 A1. According to the description of this Publication, when the reverse lever is operated to make the hull drive backward, the throttle opening degree of the engine is controlled so as not to be increased even if the opening degree of the acceleration lever may be increased. This allows the reverse drive speed of the marine vessel to be limited and thereby the reverse drive maneuvering operation to be facilitated.

SUMMARY OF THE INVENTION

The inventor of preferred embodiments of the present invention described and claimed in the present application conducted an extensive study and research regarding a marine vessel, such as the one described above, and in doing so, discovered and first recognized new unique challenges and previously unrecognized possibilities for improvements as described in greater detail below.

During a reverse drive, the water flow is directed forward with respect to the hull and partially reaches the intake port. The water flow may contain air bubbles generated due to cavitation and/or entrainment of air on the water surface. In this case, air is drawn into the jet propulsion device. This phenomenon is called air drawing.

Once air drawing occurs, it is difficult to acquire a propulsive force that a marine vessel maneuvering operator intends or desires. Air drawing can be eliminated by putting the acceleration lever back to reduce the throttle opening degree. However, eliminating air drawing causes a rapid increase in resistance from water onto the impeller of the jet propulsion device, also resulting in a rapid increase in the engine load and therefore a reduction in the engine speed. Increasing the opening degree of the acceleration lever to recover the engine speed may cause air drawing to occur again. During a reverse drive, since the engine load thus fluctuates wildly under the influence of air drawing, it is not necessarily easy to acquire a stable propulsive force.

In the above-described related art, the throttle opening degree is kept constant when the opening degree of the acceleration lever is equal to or greater than a predetermined value. However, during a reverse drive, water flow ejected from the jet propulsion device reaches the intake port, which destabilizes water intake. As a result, the impeller load fluctuates wildly and, accordingly, the engine load also fluctuates. Therefore, even if the throttle opening degree may be kept constant, the engine speed fluctuates wildly. The reduction in the propulsive force due to air drawing cannot be avoided, therefore.

In personal water crafts (PWCs), as an example of a marine vessel including a jet propulsion device, reverse buckets are arranged to guide water flow obliquely forward when viewed from above. Thus, a smaller amount of water flow reaches the intake port, and air drawing is less likely to occur. On the other hand, in jet boats (or sports boats), as another example of a marine vessel including a jet propulsion device, reverse buckets are arranged to guide water flow approximately forward when viewed from above. This is for effectively propelling the larger-sized hull. However, air drawing is actually likely to occur and the above-described problem becomes prominent, where it is difficult, during a reverse drive, to acquire a stable propulsive force.

The problem of air drawing becomes more prominent at the launching of a marine vessel. Marine vessels including a jet propulsion device have a smaller-sized hull compared to ones including another form of propulsion device. Therefore, such marine vessels are less often moored in marinas, but generally stored in owner's garages and, as necessary, transported by a trailer. Marine vessels transported by a trailer to the waterfront are launched from the trailer into the water by backward launching. Backward launching is a method in which the hull is submerged at the rear thereof and then moved from the trailer into the water using a propulsive force generated by the jet propulsion device. In this method, when the jet propulsion device takes in water vigorously through the intake port at the bottom of the hull, the water around the intake port is disturbed and all or a portion of the intake port is exposed above the water surface for a moment. Since this causes air to be drawn into the jet propulsion device, air drawing occurs. In addition, since the state of the water surface is unstable, the jet propulsion device alternates irregularly between a state where air drawing is generated and a state where the air drawing is eliminated. It is therefore difficult to generate a stable propulsive force, and thus the marine vessel maneuvering operation for backward launching is attended with difficulty. There has thus been recognized a challenge that since it is difficult to operate the acceleration lever in response to the fluctuation in the load on the jet propulsion device due to air drawing, a stable propulsive force necessary for launching is less likely to be acquired.

In order to overcome the previously unrecognized and unsolved challenges described above, a preferred embodiment of the present invention provides a marine vessel including a hull and a jet propulsion device arranged to take in water through an intake port and eject the water through an ejection port rearward with respect to the hull, the ejection port being arranged posterior to the intake port. The marine vessel also includes a reversing member arranged to be movable between a forward drive position and a reverse drive position and arranged to, when placed at the reverse drive position, reverse the direction of the water ejected from the jet propulsion device forward with respect to the hull (in a direction capable of generating a propulsive force in the reverse drive direction). The marine vessel further includes an operation unit arranged to be operated by a marine vessel maneuvering operator to locate the reversing member at the forward drive position or the reverse drive position and an internal combustion engine arranged to drive the jet propulsion device. The marine vessel still further includes a control unit arranged and programmed to operate in a reverse drive mode in which when the reversing member is located at the reverse drive position by the operation unit, such that the control unit controls the internal combustion engine to operate within a predetermined speed range.

In accordance with the arrangement above, the control unit, which is arranged and programmed to control the internal combustion engine, has a reverse drive mode that is used when the reversing member is located at the reverse drive position. In the reverse drive mode, the internal combustion engine is controlled by the control unit to operate within a predetermined speed range. That is, the throttle opening degree is not kept constant, but the engine speed is controlled to be within the predetermined range. When the load on the internal combustion engine fluctuates under the influence of air drawing, the engine speed is also to fluctuate accordingly. In this case, the control unit changes a control amount such as a throttle opening degree so that the engine speed stays within the speed range. The engine speed is thus stabilized independently of the fluctuation in the load.

The predetermined speed range is preferably predefined so that air drawing, if any, can be eliminated. This allows the engine speed to be controlled to be within the predetermined speed range, when air drawing occurs to reduce the load, and thereby causes the air drawing to be eliminated. As a result, it is possible to acquire a propulsive force that the marine vessel maneuvering operator intends. During a reverse drive, a stable propulsive force can thus be acquired independently of the fluctuation in the load on the internal combustion engine.

The predetermined speed range should be understood as a control target of the control unit in the reverse drive mode. That is, during control under the reverse drive mode, the actual engine speed does not necessarily stay within the predetermined speed range. For example, due to the limits of controlled response, the actual engine speed can vary outside of the predetermined speed range for a moment.

The predetermined speed range may include a predetermined target speed. That is, in the reverse drive mode, the control unit may be arranged and programmed to control the engine speed to be a target speed. It will be appreciated that the predetermined speed range may be between a predetermined upper limit and a predetermined lower limit. In this case, in the reverse drive mode, the control unit may be arranged and programmed to predefine a target engine speed that is variable between the upper and lower limits and to control the internal combustion engine in accordance with the target engine speed.

The marine vessel may further include an acceleration operation member arranged to be operated by the marine vessel maneuvering operator to specify a throttle opening degree of the internal combustion engine. In this case, the control unit may further be arranged and programmed to operate in a normal mode in which the control unit controls the internal combustion engine in accordance with the throttle opening degree that corresponds to the amount of operation of the acceleration operation member.

In a preferred embodiment of the present invention, the marine vessel further includes an acceleration operation member arranged to be operated by the marine vessel maneuvering operator to specify a throttle opening degree of the internal combustion engine. In this case, the control unit is preferably arranged and programmed to, when the reversing member is located at the reverse drive position, control the internal combustion engine in accordance with the throttle opening degree that corresponds to the amount of operation of the acceleration operation member (i.e., control under the normal mode) if the amount of operation is smaller than a predetermined value, and to start control of the internal combustion engine under the reverse drive mode if the amount of operation of the acceleration operation member is equal to or greater than the predetermined value.

In accordance with the arrangement above, during a reverse drive, the throttle opening degree changes in accordance with the amount of acceleration operation if the amount of acceleration operation is smaller than a predetermined value. That is, the output of the internal combustion engine fluctuates correspondingly to the acceleration operation by the marine vessel maneuvering operator. This allows the marine vessel maneuvering operator to adjust the output of the internal combustion engine within a predetermined narrow output range. When the amount of acceleration operation becomes equal to or greater than the predetermined value, on the other hand, control under the reverse drive mode is initiated. Accordingly, since the engine speed is controlled to be within the predetermined speed range, air drawing, if any, can be eliminated immediately. It is thus possible to acquire a stable propulsive force in the reverse drive direction.

In a preferred embodiment of the present invention, the marine vessel further includes an acceleration operation member arranged to be operated by the marine vessel maneuvering operator to specify a throttle opening degree of the internal combustion engine. In this case, the control unit is preferably arranged to, when the reversing member is located at the reverse drive position, control the internal combustion engine in accordance with the throttle opening degree that corresponds to the amount of operation of the acceleration operation member (i.e., control under the normal mode) if the amount of operation (i.e., amount of acceleration operation) is smaller than a predetermined value or the speed of the internal combustion engine (i.e., engine speed) is smaller than the predetermined speed range, and to start control of the internal combustion engine under the reverse drive mode if the amount of operation of the acceleration operation member is equal to or greater than the predetermined value and the speed of the internal combustion engine is equal to or greater than the predetermined speed range.

In accordance with the arrangement above, during a reverse drive, the throttle opening degree changes in accordance with the amount of acceleration operation if the amount of acceleration operation is smaller than a predetermined value. Similarly, the throttle opening degree also changes in accordance with the amount of acceleration operation if the engine speed is lower than a predetermined speed. That is, the output of the internal combustion engine fluctuates correspondingly to the acceleration operation by the marine vessel maneuvering operator. This allows the marine vessel maneuvering operator to adjust the output of the internal combustion engine within a predetermined narrow output range. When the amount of acceleration operation becomes equal to or greater than the predetermined value and the engine speed becomes equal to or greater than the predetermined speed range, control under the reverse drive mode is initiated. Accordingly, since the engine speed is controlled to be within the predetermined speed range, air drawing, if any, can be eliminated immediately. It is thus possible to acquire a stable propulsive force in the reverse drive direction. Since conditions for initiating the reverse drive mode are provided not only for the amount of acceleration operation but also for the engine speed, the range within which the marine vessel maneuvering operator can adjust the output of the internal combustion engine can be widened. This facilitates adjustment of a propulsive force during a reverse drive.

The control unit may be arranged and programmed to calculate a target throttle opening degree at which the internal combustion engine operates within the predetermined speed range in the reverse drive mode and to control the internal combustion engine in accordance with the target throttle opening degree. The control unit may further be arranged and programmed to calculate an amount of virtual acceleration operation that corresponds to the target throttle opening degree and to release the reverse drive mode when the amount of operation of the acceleration operation member becomes smaller than the amount of virtual acceleration operation by a predetermined value or more.

In accordance with the arrangement above, the reverse drive mode is initiated if the amount of acceleration operation reaches a predetermined value. Then, when the amount of acceleration operation becomes smaller than the amount of virtual acceleration operation, which corresponds to the target throttle opening degree within the predetermined speed range, by a predetermined value or more, the reverse drive mode is released. Thus, hysteresis is provided to both the initiation and the release of the reverse drive mode. As a result, the control can be stabilized and, in addition, air drawing, if any, can be eliminated immediately. It is thus possible to acquire a stable propulsive force in the reverse drive direction.

In a preferred embodiment of the present invention, the marine vessel further includes a characteristic change operation unit arranged to be operated by the marine vessel maneuvering operator to change the predetermined speed range (stepwise, for example). In this case, the control unit is preferably arranged and programmed to change the predetermined speed range in response to the operation of the characteristic change operation unit (within a range between a predetermined upper limit and a predetermined lower limit, for example).

In accordance with the arrangement above, the marine vessel maneuvering operator can change and adjust the range of the engine speed in the reverse drive mode appropriately based on the environment of usage such as the actual load (e.g., number of crews and/or passengers) and/or conditions (e.g., size of the slope on the waterfront). This provides a further stable propulsive force during a reverse drive.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
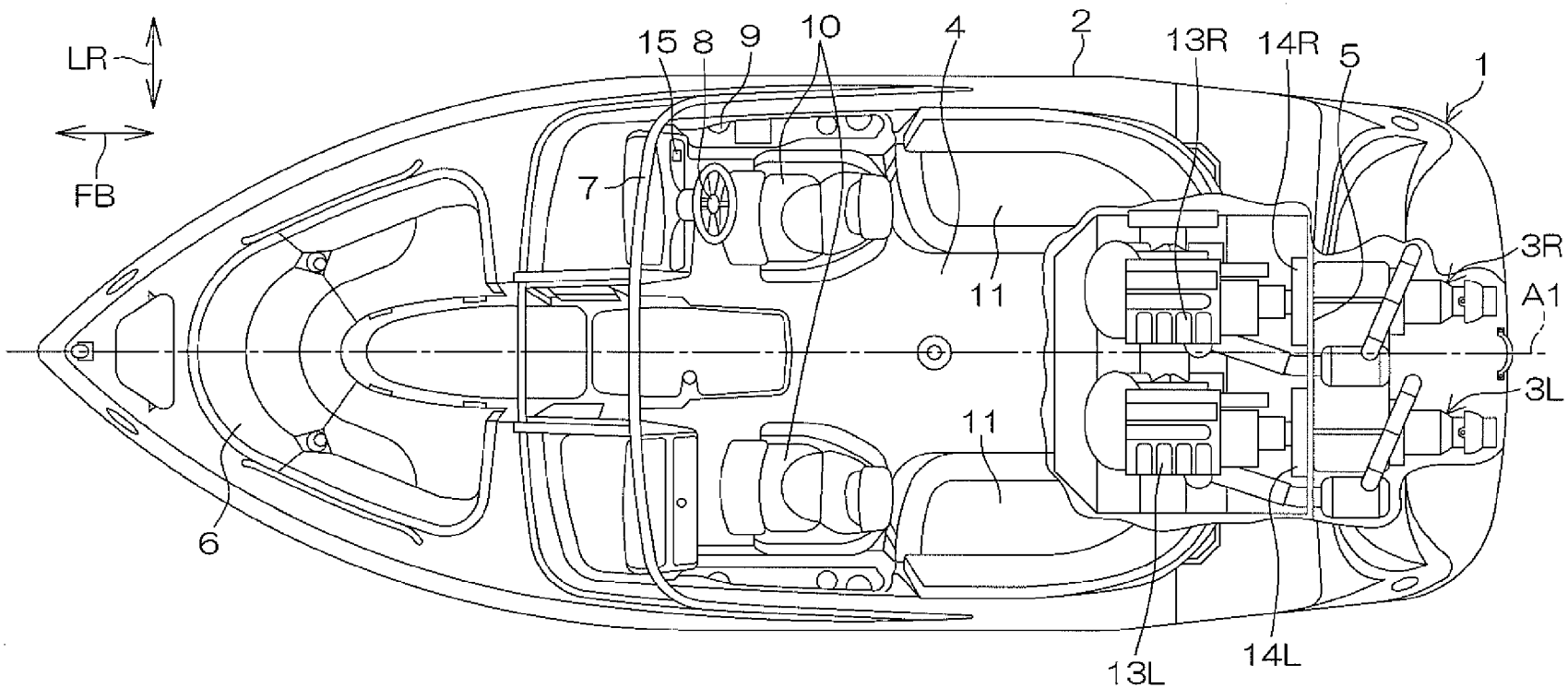
FIG. 1 is a plan view schematically illustrating the configuration of a water jet propulsion watercraft according to a preferred embodiment of the present invention.
Figure 2:
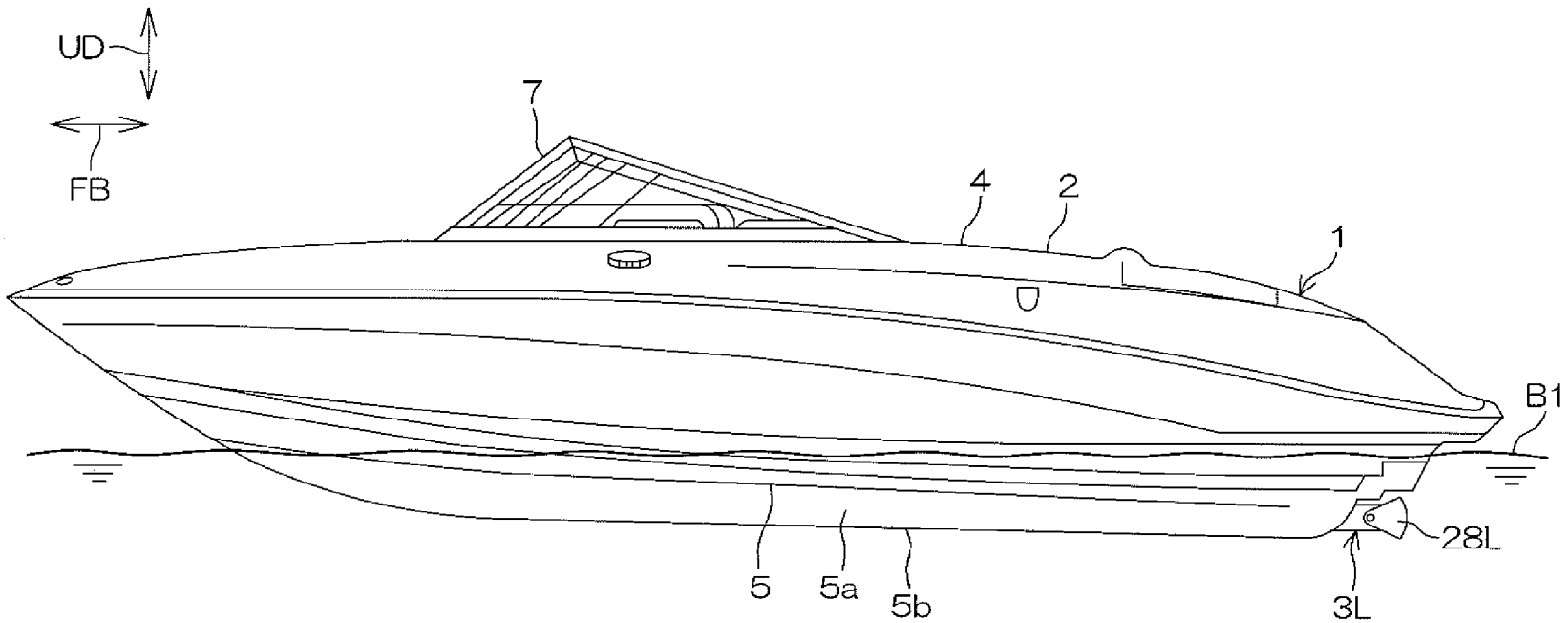
FIG. 2 is a left side view of the water jet propulsion watercraft, illustrating a stationary state on the water.

FIG. 1 is a plan view schematically illustrating the configuration of a water jet propulsion watercraft 1 according to a preferred embodiment of the present invention, where the hull is partially broken to expose a portion of its internal construction. FIG. 2 is a left side view of the water jet propulsion watercraft 1, illustrating a stationary state on the water.

The water jet propulsion watercraft 1 is a marine vessel used to travel on the water such as a lake or the sea. The water jet propulsion watercraft 1 in this preferred embodiment is of a type called a jet boat or sports boat, having a relatively large-scaled hull 2. The water jet propulsion watercraft 1 includes the hull 2 and a pair of right and left jet propulsion devices 3R and 3L mounted on the hull 2 and arranged symmetrically on either side of the hull centerline A1. The hull centerline A1 is a straight line running through the center of the stem and the stern when viewed from above.

The hull 2 is elongated in the front-back direction FB thereof and has a predetermined width in the left-right direction LR thereof. In addition, in the following description, the front-back direction FB of the hull 2 is referred to merely as "front-back direction FB." Similarly, the left-right direction LR of the hull 2 is referred to merely as "left-right direction LR." In addition, the up-down direction of the hull 2 when the water jet propulsion watercraft 1 remains stationary in a normal posture on the water is referred to merely as "up-down direction UD." Further, simple terms "laterally," "longitudinally," and "vertically" mean the left-right direction, front-back direction, and up-down direction of the hull 2, respectively.

The hull 2 includes a deck 4 and a lower hull structure 5. The lower hull structure 5 is arranged under the deck 4 and has an approximately symmetrical shape on either side of a ridge line 5*b* that is formed on the bottom surface 5*a* of the lower hull structure 5 (bottom of the hull) and extends longitudinally. The ridge line 5*b* corresponds with the hull centerline A1 when viewed from above.

The floor surface of the deck 4 is approximately in parallel with the front-back direction FB and left-right direction LR. On the deck 4, a front seat 6, a pair of right and left center seats 10, and rear seats 11 are arranged in this order from front to back. A windshield 7 is arranged between the front seat 6 and the center seats 10. One of the pair of center seats 10 is for a marine vessel maneuvering operator (an operator's seat). A steering wheel 8 is arranged in front of the operator's seat, and an acceleration/shift lever 9 is arranged beside the operator's seat. Further, in the vicinity of the operator's seat, a characteristic change operation unit 15 is provided. The characteristic change operation unit 15 is arranged to be operated by the marine vessel maneuvering operator to change the output characteristics during a reverse drive. The characteristic change operation unit 15 may be provided in the vicinity of the steering wheel 8 or the acceleration/shift lever 9.

The steering wheel 8 is an operation member arranged to be operated by the marine vessel maneuvering operator to turn the hull 2. The direction in which the pair of right and left jet propulsion devices 3R and 3L eject water can be changed laterally by operating the steering wheel 8.

The acceleration/shift lever 9 is another operation member arranged to be operated by the marine vessel maneuvering operator. The marine vessel maneuvering operator can adjust the output of engines 13R and 13L arranged to drive the pair of respective right and left jet propulsion devices 3R and 3L by operating the lever 9 as well as switch the heading direction of the hull 2 between forward drive and reverse drive. That is, the acceleration/shift lever 9 has features as both an operation member to switch between forward drive and reverse drive and an acceleration operation member to adjust the engine output.

The pair of right and left engines 13R and 13L, pair of right and left engine ECUs (Electronic Control Units) 14R and 14L, and pair of right and left jet propulsion devices 3R and 3L are installed in the lower hull structure 5.

The pair of right and left engines 13R and 13L are arranged symmetrically and fixed nearer the stern in the lower hull structure 5. The engines 13R and 13L are, for example, multi-cylinder four-stroke internal combustion engines. The left engine 13L is a drive source arranged to drive the left jet propulsion device 3L. The right engine 13R is a drive source arranged to drive the right jet propulsion device 3R. The jet propulsion devices 3R and 3L are driven by the respective engines 13R and 13L to take in and eject water through the bottom of the hull. This provides a propulsive force to the hull 2. The left engine ECU 14L is arranged to control the left engine 13L. The right engine ECU 14R is arranged to control the right engine 13R.

Figure 3:
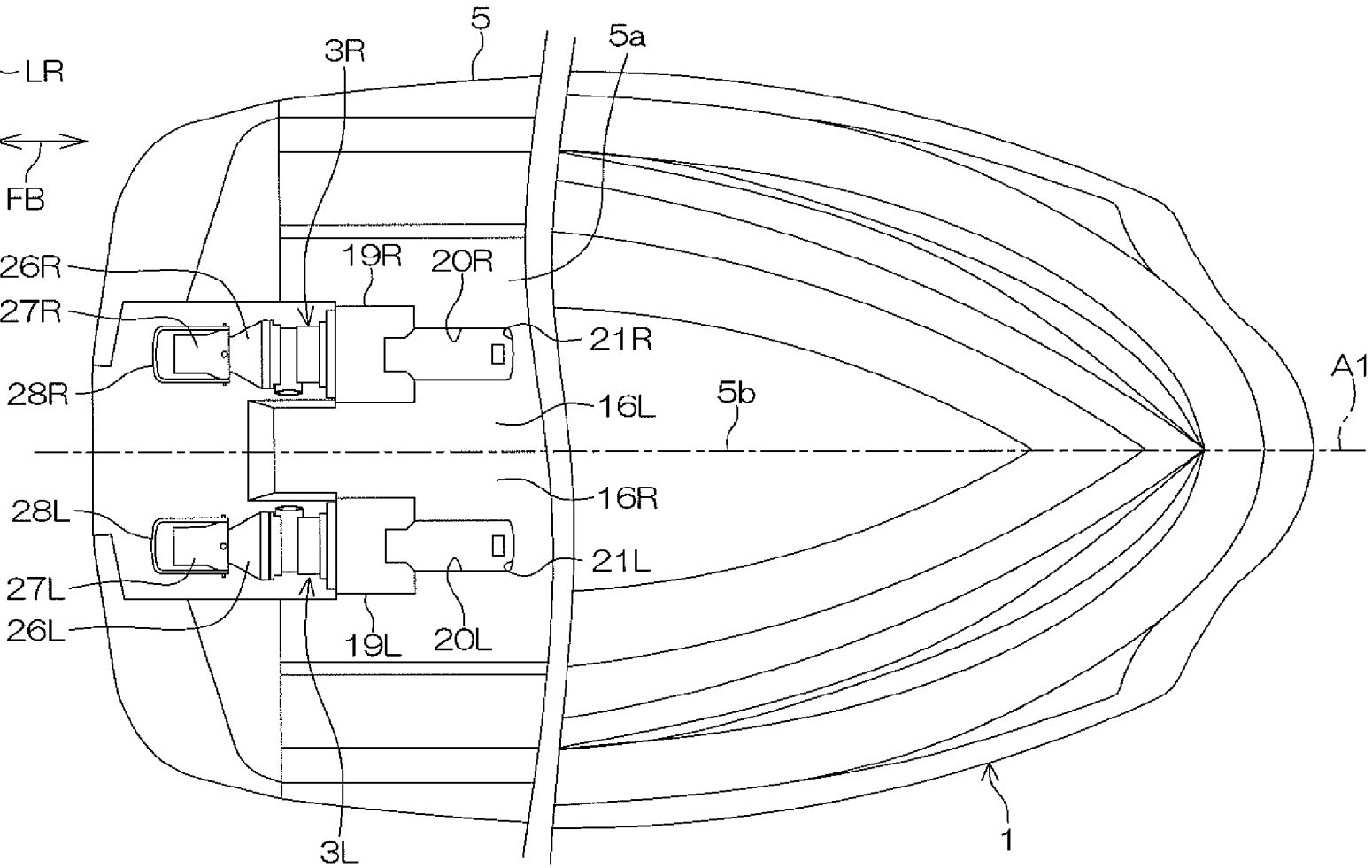
FIG. 3 is a bottom view of the water jet propulsion watercraft.
Figure 4:
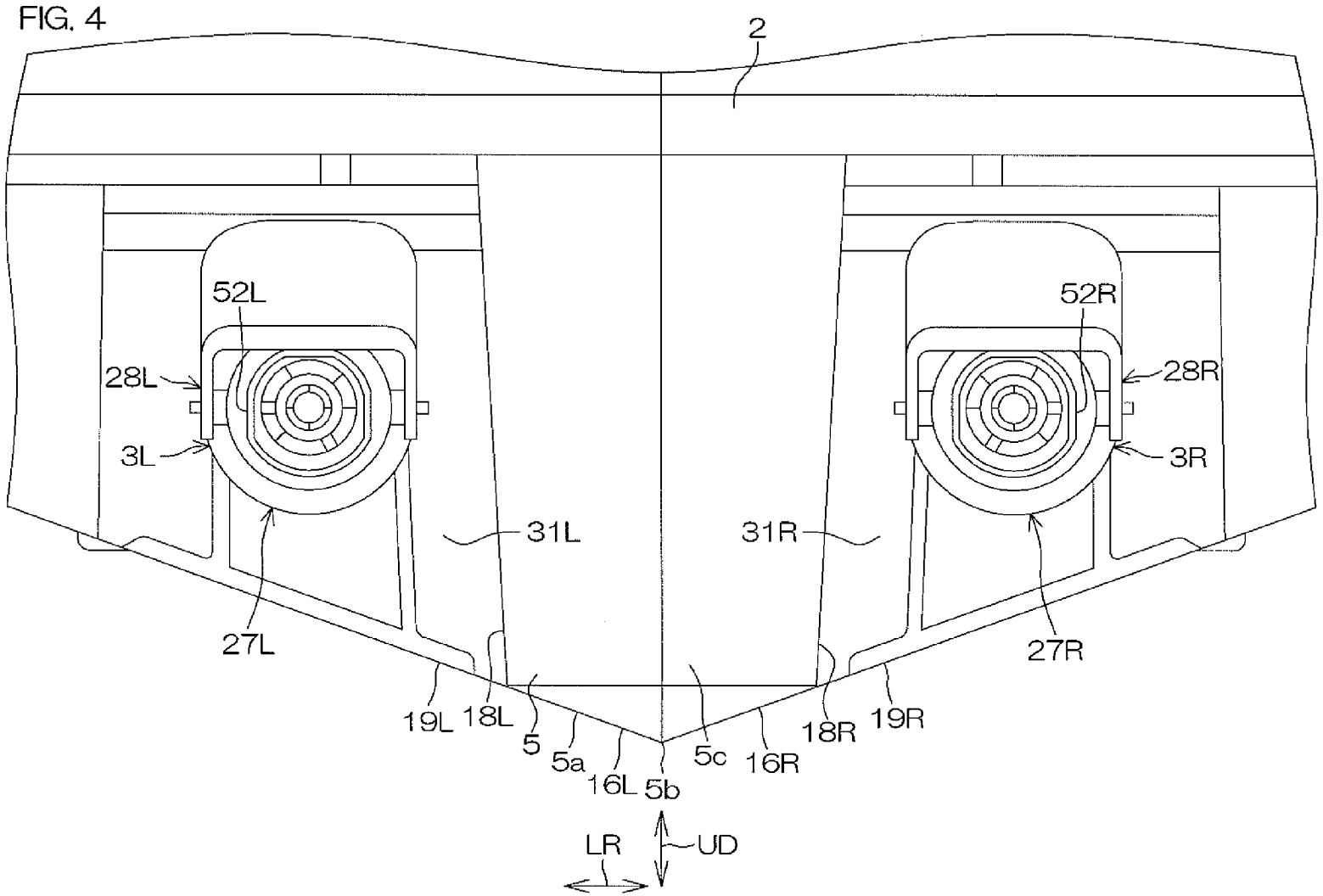
FIG. 4 is a partial rear view in the vicinity of right and left jet propulsion devices when viewed from the rear of the hull.
Figure 5:
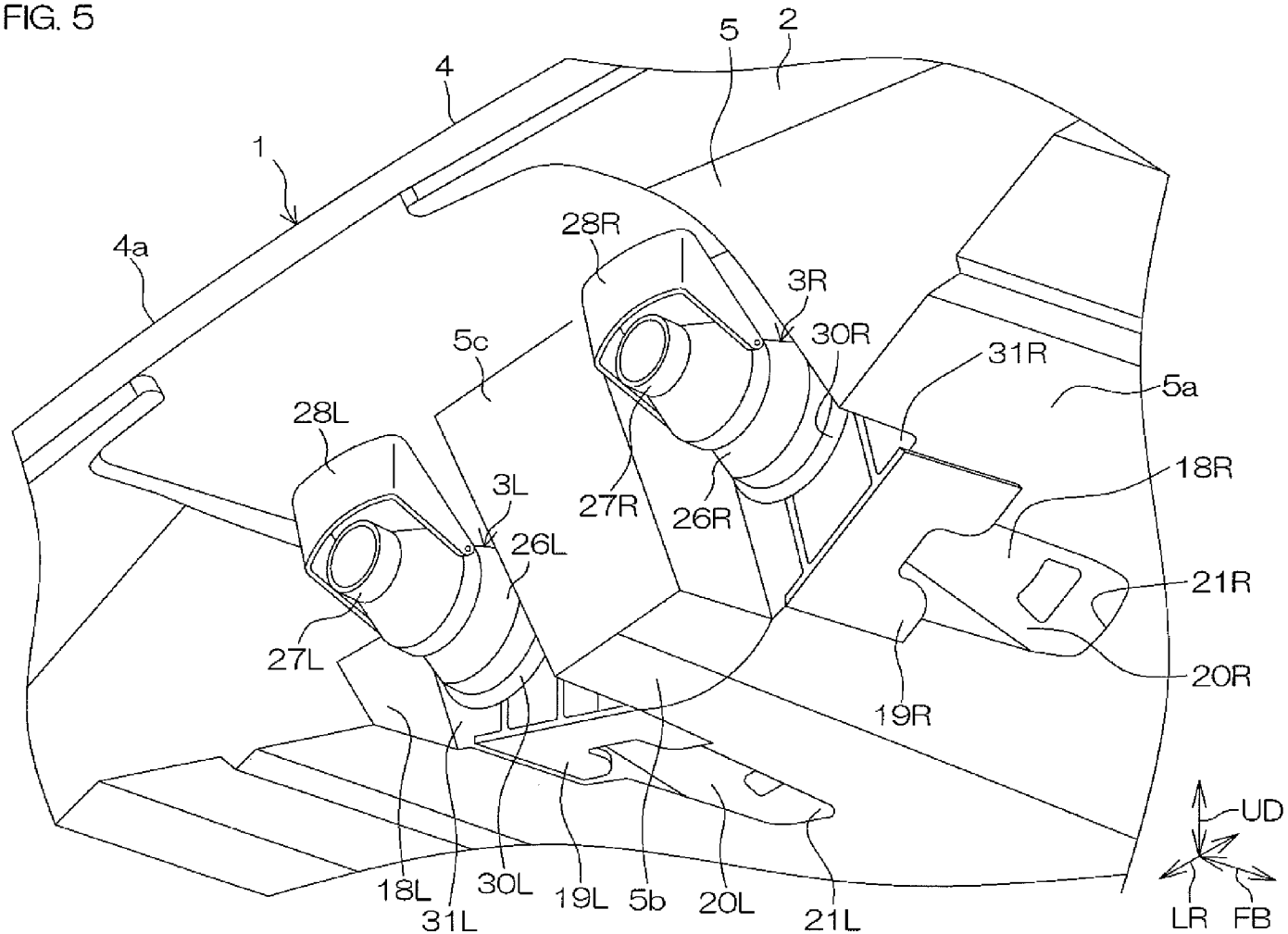
FIG. 5 is a perspective view of the rear portion of the water jet propulsion watercraft when viewed from below the hull.

FIG. 3 is a bottom view of the water jet propulsion watercraft 1. FIG. 4 is a partial rear view in the vicinity of the right and left jet propulsion devices 3R and 3L when viewed from the rear of the hull 2. FIG. 5 is a perspective view of the rear portion of the water jet propulsion watercraft 1 when viewed from below the hull 2.

A pair of right and left inclined surfaces 16R and 16L are arranged symmetrically in the rear end portion of the bottom surface 5*a* of the lower hull structure 5. The left inclined surface 16L is inclined left-upward from the ridge line 5*b*. The right inclined surface 16R is inclined right-upward from the ridge line 5*b*. Therefore, the bottom surface 5*a* of the hull 2 defines slopes rising laterally from the center (ridge line 5*b*).

The left jet propulsion device 3L is arranged on the upper left side of the ridge line 5*b*, while the right jet propulsion device 3R is arranged on the upper right side of the ridge line 5*b*.

The rear portion 4*a* of the deck 4 hangs rearward over the rear end of the lower hull structure 5. A pair of right and left recessed portions 18R and 18L are arranged symmetrically at the rear end of the bottom portion of the lower hull structure 5. The right and left recessed portions 18R and 18L are arranged to house therein a portion of the left jet propulsion device 3L and a portion of the right jet propulsion device 3R, respectively.

The left recessed portion 18L is arranged on the left side of the ridge line 5*b*. The left recessed portion 18L extends longitudinally to be located between the rear end portion of the bottom surface 5*a* and the rear surface 5*c* of the lower hull structure 5, and opened rearward at the rear surface 5*c*. The ceiling surface of the left recessed portion 18L is inclined as rising rearward. Similarly, the right recessed portion 18R is arranged on the right side of the ridge line 5*b*. The right recessed portion 18R extends longitudinally to be located between the rear end portion of the bottom surface 5*a* and the rear surface 5*c* of the lower hull structure 5, and opened rearward at the rear surface 5*c*. The ceiling surface of the right recessed portion 18R is inclined as rising rearward.

Figure 6:
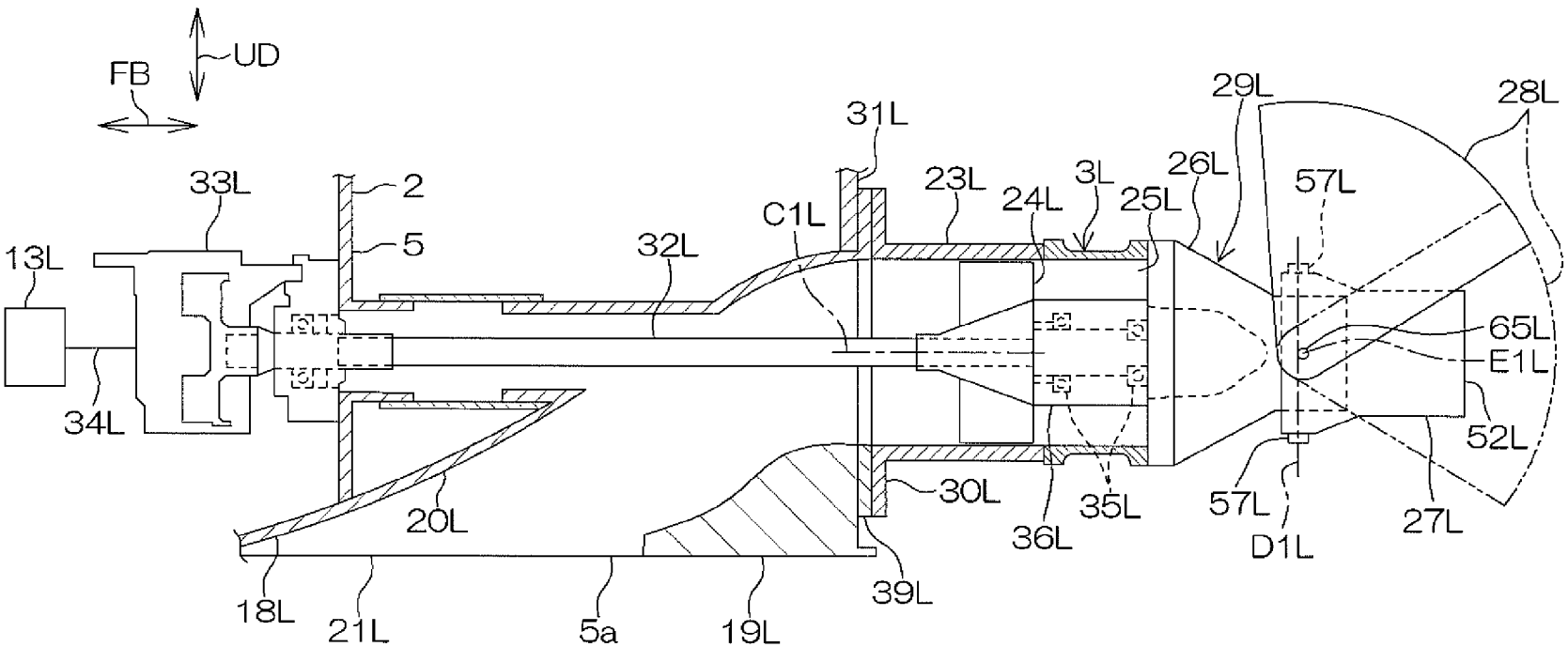
FIG. 6 is a vertical cross-sectional view illustrating the configuration of the left jet propulsion device when viewed from the left.

FIG. 6 is a vertical cross-sectional view illustrating the configuration of the left jet propulsion device 3L when viewed from the left. A plate member 19L is attached upward at the rear end portion of the recessed portion 18L. The plate member 19L covers the rear end portion of the recessed portion 18L upward. The recessed portion 18L and the plate member 19L constitute an intake duct 20L.

At the front end of the intake duct 20L, an intake 21L is arranged and is opened through the bottom surface 5*a* of the lower hull structure 5. The intake duct 20L is arranged to guide water taken in through the intake 21L to an ejection nozzle 26L. The jet propulsion device 3L is arranged posterior to the intake 21L. The intake 21L and the jet propulsion device 3L are aligned in the front-back direction FB.

The jet propulsion device 3L includes an ejection unit 29L, a deflector 27L, and a bucket 28L. The ejection unit 29L is arranged to take water in through the bottom of the hull 2 and eject the water rearward with respect to the hull 2. The ejection unit 29L includes a housing 23L, an impeller 24L, a stator vane 25L, and an ejection nozzle 26L. The impeller 24L and the stator vane 25L are arranged inside the housing 23L.

The housing 23L is preferably cylindrical. An annular flange 30L is provided at the front end of the housing 23L. The annular flange 30L faces the transom surface 31L of the lower hull structure 5 with an annular transom plate 39L therebetween. The annular flange 30L is fixed to the transom surface 31L via bolts or other fastening unit (not shown). The intake duct 20L is opened at the transom surface 31L. The space inside the housing 23L communicates with the space inside the intake duct 20L.

The impeller 24L is arranged to take in water through the intake duct 20L and pump the water to the ejection nozzle 26L. The impeller 24L includes multiple blades arranged radially around its rotation axis C1L. The impeller 24L is fixed to an intermediate portion of a drive shaft 32L.

The drive shaft 32L extends longitudinally to transmit the output of the engine 13L to the impeller 24L. The drive shaft 32L is arranged inside the housing 23L and the intake duct 20L.

The front end portion of the drive shaft 32L is coupled via a coupling 33L to a crankshaft 34L of the engine 13L in a power transmittable manner. The rear end portion of the drive shaft 32L is inserted through an inner cylinder 36L arranged inside the housing 23L. The drive shaft 32L is supported rotatably on the inner cylinder 36L via a pair of bearings 35L arranged longitudinally in the inner cylinder 36L.

The stator vane 25L is a flow straightener blade arranged to straighten water flow generated by the rotation of the impeller 24L. The stator vane 25L is arranged posterior to the impeller 24L. The stator vane 25L includes multiple blades fixed inside the housing 23L. The outer peripheral portion of each blade is fixed to the housing 23L, while the inner peripheral portion is fixed to the inner cylinder 36L.

The ejection nozzle 26L is a cylindrical member through which water flow generated by the rotation of the impeller 24L passes, and fixed to the rear end portion of the housing 23L. The axially intermediate portion of the ejection nozzle 26L preferably has a truncated cone shape with an inside diameter decreasing rearward. The rear end portion of the ejection nozzle 26L preferably has a cylindrical shape with an approximately constant inside diameter. With this arrangement, the ejection nozzle 26L is arranged to accelerate and eject water flow generated by the impeller 24L rearward.

The deflector 27L is arranged posterior to the ejection nozzle 26L and is arranged to change the direction of water ejected from the ejection nozzle 26L. The deflector 27L preferably has a hollow shape to eject water ejected from the ejection nozzle 26L rearward or forward with respect to the hull 2. The deflector 27L has an ejection port 52L that is opened rearward.

The deflector 27L is supported on the ejection nozzle 26L via bolts 57L. The bolts 57L are arranged over and beneath the ejection nozzle 26L along a lateral rotation axis D1L extending in the up-down direction UD. Therefore, the deflector 27L is rotatable laterally about the lateral rotation axis D1L with respect to the ejection nozzle 26L. This allows the deflector 27L to change the direction of water flow laterally.

The bucket 28L is arranged to cover the ejection port 52L of the deflector 27L to make the water jet propulsion watercraft 1 drive backward. The bucket 28L is arranged adjacent to the deflector 27L.

More specifically, the bucket 28L is supported on the deflector 27L via bolts 65L. The bolts 65L are arranged on the right and left sides of the deflector 27L along a vertical rotation axis E1L extending in the left-right direction LR (only the left bolt 65L is shown in FIG. 6). The bucket 28L is rotatable vertically about the vertical rotation axis E1L with respect to the deflector 27L. The bucket 28L is also rotatable laterally together with the deflector 27L.

The bucket 28L is rotatable vertically between a forward drive position and a reverse drive position. At the forward drive position, the bucket 28L is retreated above the ejection port 52L of the deflector 27L, as indicated by the solid line in FIG. 6. On the other hand, at the reverse drive position, the bucket 28L faces the ejection port 52L of the deflector 27L, as indicated by the phantom line in FIG. 6. At the reverse drive position, since the bucket 28L covers the ejection port 52L, water flow ejected through the ejection port 52L is reversed by the bucket 28L to flow forward. That is, the bucket 28L is arranged to reverse the direction of water flow ejected rearward from the jet propulsion device 3L forward. "Forward" is a direction in which a propulsive force in the reverse drive direction can be provided to the hull 2. That is, the direction of ejection of water flow when the bucket 28L is located at the reverse drive position is not necessarily required to be in parallel with the centerline A1 of the hull 2, but is required to have a component directed forward along the centerline A1 of the hull 2.

In this preferred embodiment, when the bucket 28L is located at the reverse drive position, water flow reversed by the bucket 28L is directed obliquely downward and forward with respect to the hull 2.

As shown in FIG. 5, the portion of the left jet propulsion device 3L that is posterior to the ejection nozzle 26L protrudes rearward from the left recessed portion 18L to be arranged beneath the rear portion 4*a* of the deck.

Figure 7:
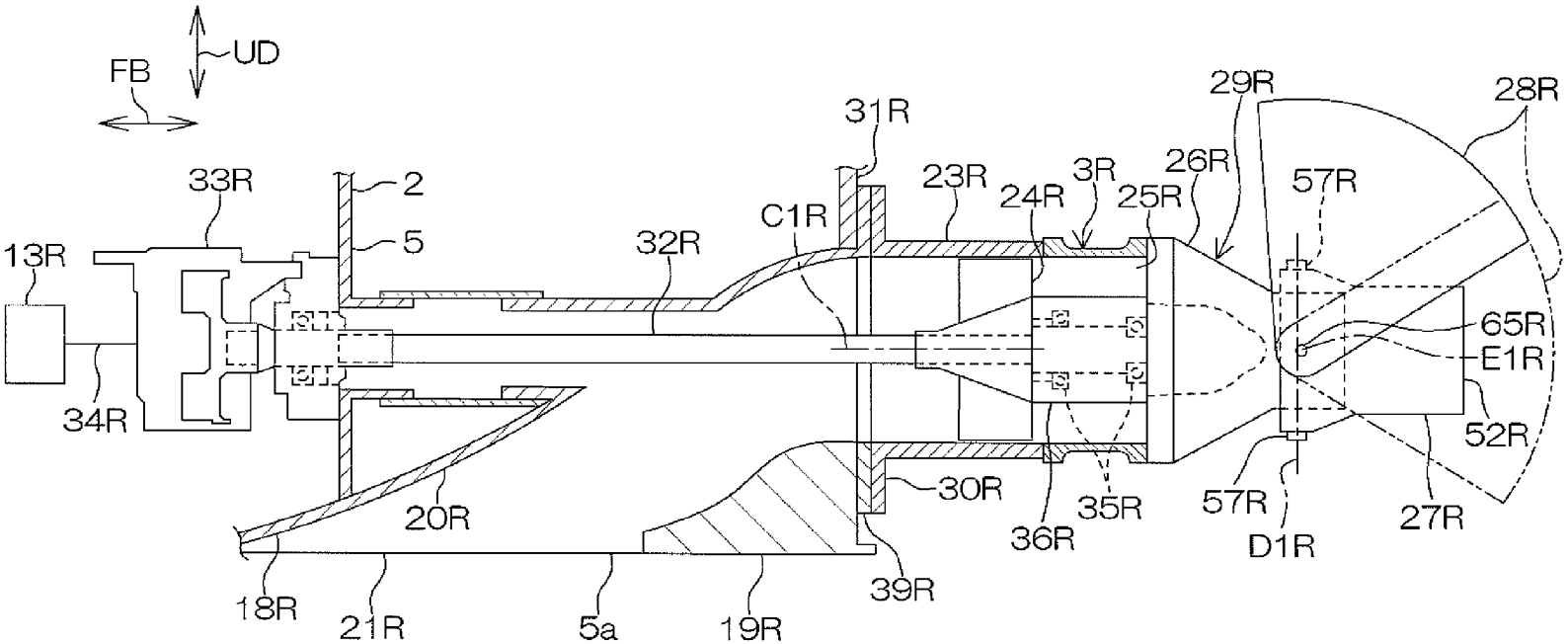
FIG. 7 is a vertical cross-sectional view illustrating the configuration of the right jet propulsion device when viewed from the left.

FIG. 7 is a vertical cross-sectional view illustrating the configuration of the right jet propulsion device 3R when viewed from the left. The configuration of the right jet propulsion device 3R is approximately the same as the configuration of the left jet propulsion device 3L. Hence, in FIG. 7, components corresponding to those described above in connection with the left jet propulsion device 3L are designated by the same reference numerals with a letter "R" added to the end thereof to omit detailed descriptions.

Figure 8:
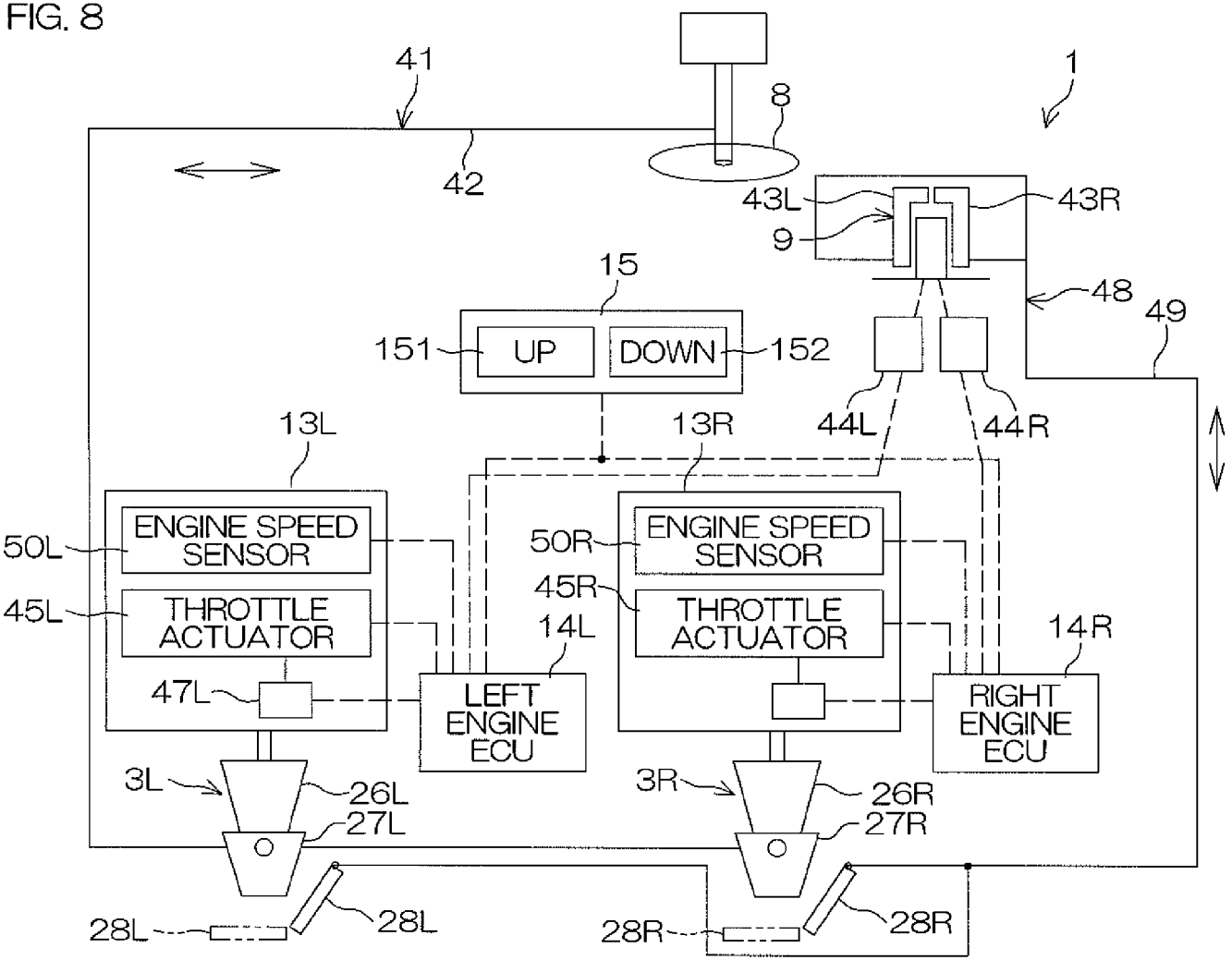
FIG. 8 schematically illustrates an arrangement relating to the change in the heading direction and the control of the output of the water jet propulsion watercraft.

FIG. 8 schematically illustrates an arrangement relating to the change in the heading direction and the control of the output of the water jet propulsion watercraft 1. The water jet propulsion watercraft 1 includes an interlocking mechanism 41 arranged to interlock and laterally rotate the right and left deflectors 27R and 27L. The interlocking mechanism 41 includes the steering wheel 8 and a steering cable 42.

The steering wheel 8 is connected with one end of the steering cable 42. The steering cable 42 is, for example, a push-pull one arranged to be pushed and pulled by the rotational operation of the steering wheel 8. The other end of the steering cable 42 is connected to the right and left deflectors 27R and 27L.

The torque of the steering wheel 8 is transmitted to the right and left deflectors 27R and 27L via the steering cable 42. This allows the right and left deflectors 27R and 27L to be interlocked and rotated laterally.

The acceleration/shift lever 9 includes right and left levers 43R and 43L. The levers 43R and 43L are arranged to be rotatable back and forth about a rotation center defined by the lower end of each lever. The rotational position of the left lever 43L is detected by a left acceleration position sensor 44L. Similarly, the rotational position of the right lever 43R is detected by a right acceleration position sensor 44R. The acceleration position sensors 44R and 44L are connected electrically to the respective right and left engine ECUs 14R and 14L to output signals corresponding to the positions of the respective levers 43R and 43L.

The characteristic change operation unit 15 includes an increase switch 151 and a decrease switch 152. The characteristic change operation unit 15 is connected electrically to the right and left engine ECUs 14R and 14L. The characteristic change operation unit 15 is arranged to input a signal representing the operation of the switch 151 or 152 to the right and left engine ECUs 14R and 14L. The characteristic change operation unit 15 is also arranged to be operated by the marine vessel maneuvering operator to adjust the engine output during a reverse drive. When the increase switch 151 is operated, the engine ECUs 14R and 14L increase the engine output during a reverse drive. When the decrease switch 152 is operated, the engine ECUs 14R and 14L decrease the engine output during a reverse drive.

The left engine ECU 14L is connected electrically to a left throttle actuator 45L provided in the left engine 13L to control the drive of the left throttle actuator 45L. This leads to controlling the opening degree of the throttle valve (throttle opening degree) and therefore the output of the left engine 13L. The throttle opening degree of the left engine 13L is detected by a left throttle position sensor 47L, and the detection signal is input to the left engine ECU 14L. Similarly, the right engine ECU 14R is connected electrically to a right throttle actuator 45R provided in the right engine 13R to control the drive of the right throttle actuator 45R. This leads to controlling the throttle opening degree and therefore the output of the right engine 13R. The throttle opening degree of the right engine 13R is detected by a right throttle position sensor 47R, and the detection signal is input to the right engine ECU 14R.

The engines 13R and 13L include engine speed sensors 50R and 50L, respectively. The engine speed sensors 50R and 50L may be, for example, crank angle sensors to detect the crank angle of the respective engines 13R and 13L. Output signals from the engine speed sensors 50R and 50L are input, respectively, to the right and left engine ECUs 14R and 14L. The engine ECUs 14R and 14L control the respective engines 13R and 13L based on the output signals from the respective engine speed sensors 50R and 50L. In particular, during a reverse drive, the engine ECUs 14R and 14L control the throttle opening degree of the respective engines 13R and 13L based on the output signals from the respective engine speed sensors 50R and 50L.

The water jet propulsion watercraft 1 further includes a bucket interlocking mechanism 48 arranged to interlock and move the right and left buckets 28R and 28L between the forward and reverse drive positions.

The bucket interlocking mechanism 48 includes aright lever 43R, a left lever 43L, and an operation cable 49. The operation cable 49 is, for example, a push-pull one arranged to be pushed and pulled by the operation of the levers 43R and 43L. One end of the operation cable 49 is branched to be connected to the right and left levers 43R and 43L. The other end of the operation cable 49 is also branched to be connected to the right and left buckets 28R and 28L.

For example, when the right and left levers 43R and 43L are in their respective predetermined neutral positions, the right and left engines 13R and 13L are both in an idle state.

When the right and left levers 43R and 43L are operated forward from their respective neutral positions, the output signals from the right and left acceleration position sensors 44R and 44L change. When the right and left levers 43R and 43L are operated forward by a certain amount or more from their respective neutral positions, the control for increasing the output of the right and left engines 13R and 13L is performed.

Similarly, when the right and left levers 43R and 43L are operated backward from their respective neutral positions, the output signals from the right and left acceleration position sensors 44R and 44L change. When the right and left levers 43R and 43L are operated backward by a certain amount or more from their respective neutral positions, the control for increasing the output of the right and left engines 13R and 13L is performed.

Further, when the right and left levers 43R and 43L are operated backward by a certain amount or more from their respective neutral positions, the operational forces put on the right and left levers 43R and 43L are transmitted to the right and left buckets 28R and 28L via the operation cable 29. This causes the left bucket 28L to move from the forward drive position to the reverse drive position posterior to the left deflector 27L and the right bucket 28R to move from the forward drive position to the reverse drive position posterior to the right deflector 27R. In FIG. 8, the right and left buckets 28R and 28L at the forward drive position are indicated by solid lines, while the right and left buckets 28R and 28L at the reverse drive position are indicated by phantom lines.

The operational range of the levers 43R and 43L when the buckets 28R and 28L are arranged at the reverse drive position will hereinafter be referred to as "reverse drive operational range." The engine ECUs 14R and 14L are arranged to determine if the operational positions of the levers 43R and 43L are within the reverse drive operational range based on the outputs from the respective acceleration position sensors 44R and 44L.

When the left lever 43L is turned back toward its neutral position and the amount of operation thereof becomes smaller than a certain amount, the left bucket 28L returns from the position posterior to the left deflector 27L to the forward drive position. Similarly, when the right lever 43R is turned back toward its neutral position and the amount of operation thereof becomes smaller than a certain amount, the right bucket 28R is retreated from the position posterior to the right deflector 27R to return to the forward drive position.

Although the bucket interlocking mechanism 48 may be arranged to interlock the buckets 28R and 28L mechanically with the operation of the levers 43R and 43L, another structure may be adopted. For example, the buckets 28R and 28L may be actuated by a hydraulic apparatus or another type of actuator. In this case, the engine ECUs 14R and 14L are preferably arranged to control the actuator based on the outputs from the respective acceleration position sensors 44R and 44L.

Figure 9:
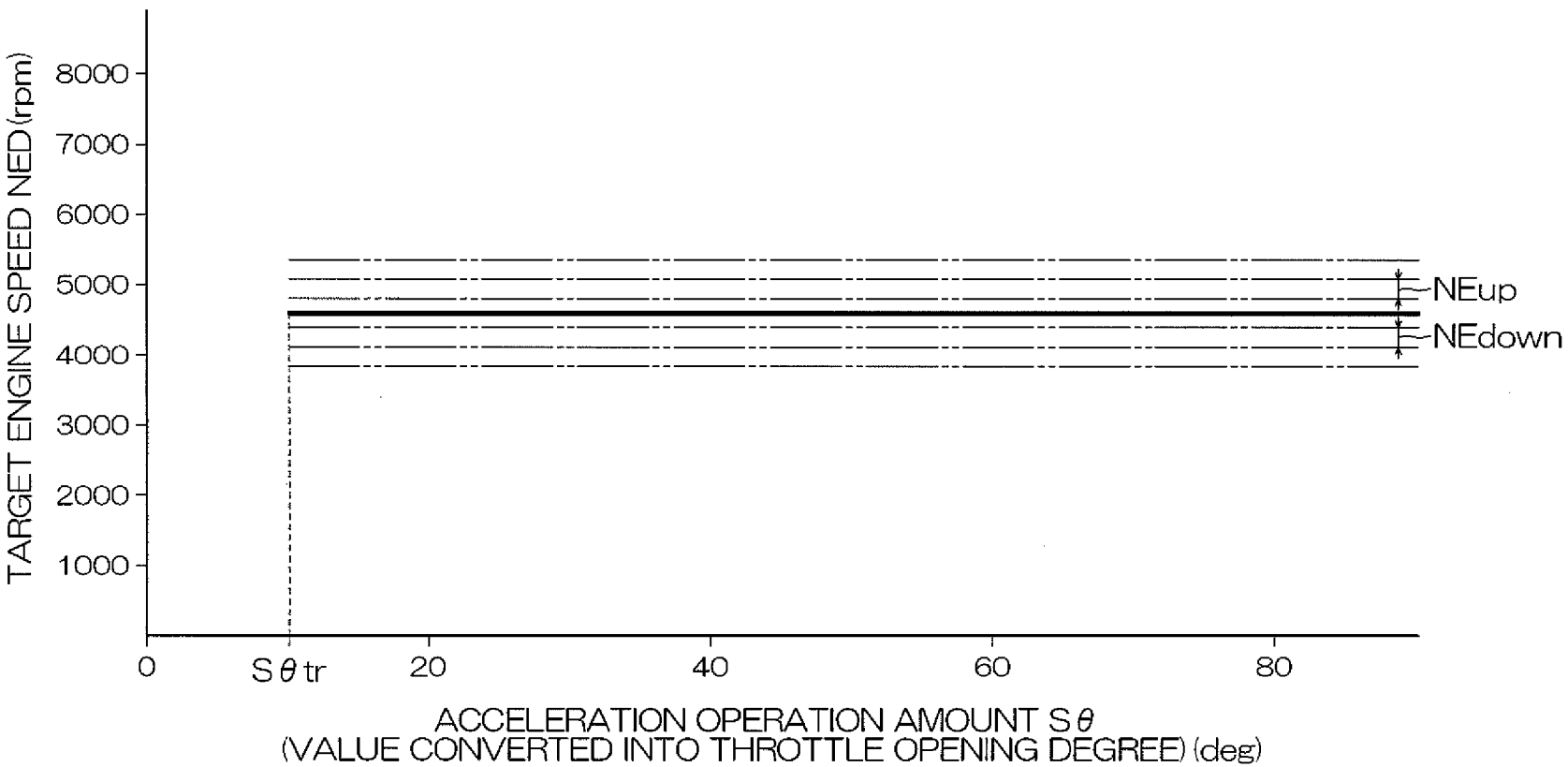
FIG. 9 is a graph showing engine control characteristics that an engine ECU performs during a reverse drive.

FIG. 9 is a graph showing engine control characteristics that the engine ECUs 14R and 14L (hereinafter, collectively referred to as "engine ECU 14" as appropriate) perform during a reverse drive. When the buckets 28R and 28L (hereinafter, collectively referred to as "bucket 28" as appropriate) are controlled to be at the reverse drive position, the engine ECU 14 controls the engines 13R and 13L (hereinafter, collectively referred to as "engine 13" as appropriate) in accordance with one of the characteristics indicated by the solid line and the alternate long and two short dashed lines in FIG. 9.

The engine ECU 14 monitors the acceleration operation amount $S\theta$ detected by the acceleration position sensors 44R and 44L (hereinafter, collectively referred to as "acceleration position sensor 44" as appropriate). While the acceleration operation amount $S\theta$ is smaller than a predetermined control start acceleration operation amount $S\theta_{tr}$, the engine ECU 14 sets a target throttle opening degree according to the acceleration operation amount $S\theta$. The engine ECU 14 then controls the throttle actuators 45R and 45L (hereinafter, collectively referred to as "throttle actuator 45" as appropriate) so that the throttle opening degree becomes equal to the target throttle opening degree. The throttle opening degree is detected by the throttle position sensors 47R and 47L (hereinafter, collectively referred to as "throttle position sensor 47" as appropriate).

On the contrary, while the acceleration operation amount $S\theta$ is equal to or greater than the control start acceleration operation amount $S\theta_{tr}$, the engine ECU 14 controls the throttle opening degree so that the engine speed becomes constant. Specifically, the engine ECU 14 sets a constant target engine speed NED independently of the acceleration operation amount $S\theta$. The engine ECU 14 acquires the actual engine speed of the engine 13 from the engine speed sensors 50R and 50L (hereinafter, collectively referred to as "engine speed sensor 50" as appropriate). The engine ECU 14 then controls the throttle actuator 45 and adjusts the throttle opening degree so that the acquired engine speed becomes equal to the target engine speed NED.

The constant target engine speed NED, which is applied during a reverse drive, can be increased and decreased by operating the characteristic change operation unit 15. The basic characteristic before such increase or decrease is indicated by the solid line in FIG. 9. The target engine speed characteristics after such increase and decrease are also indicated by the alternate long and two short dashed lines in FIG. 9. In this preferred embodiment, the engine ECU 14 changes the target engine speed NED during a reverse drive stepwise at a predetermined amount of change ($NE_{up}$ and $NE_{down}$) in accordance with the operation of the characteristic change operation unit 15.

Figure 10:
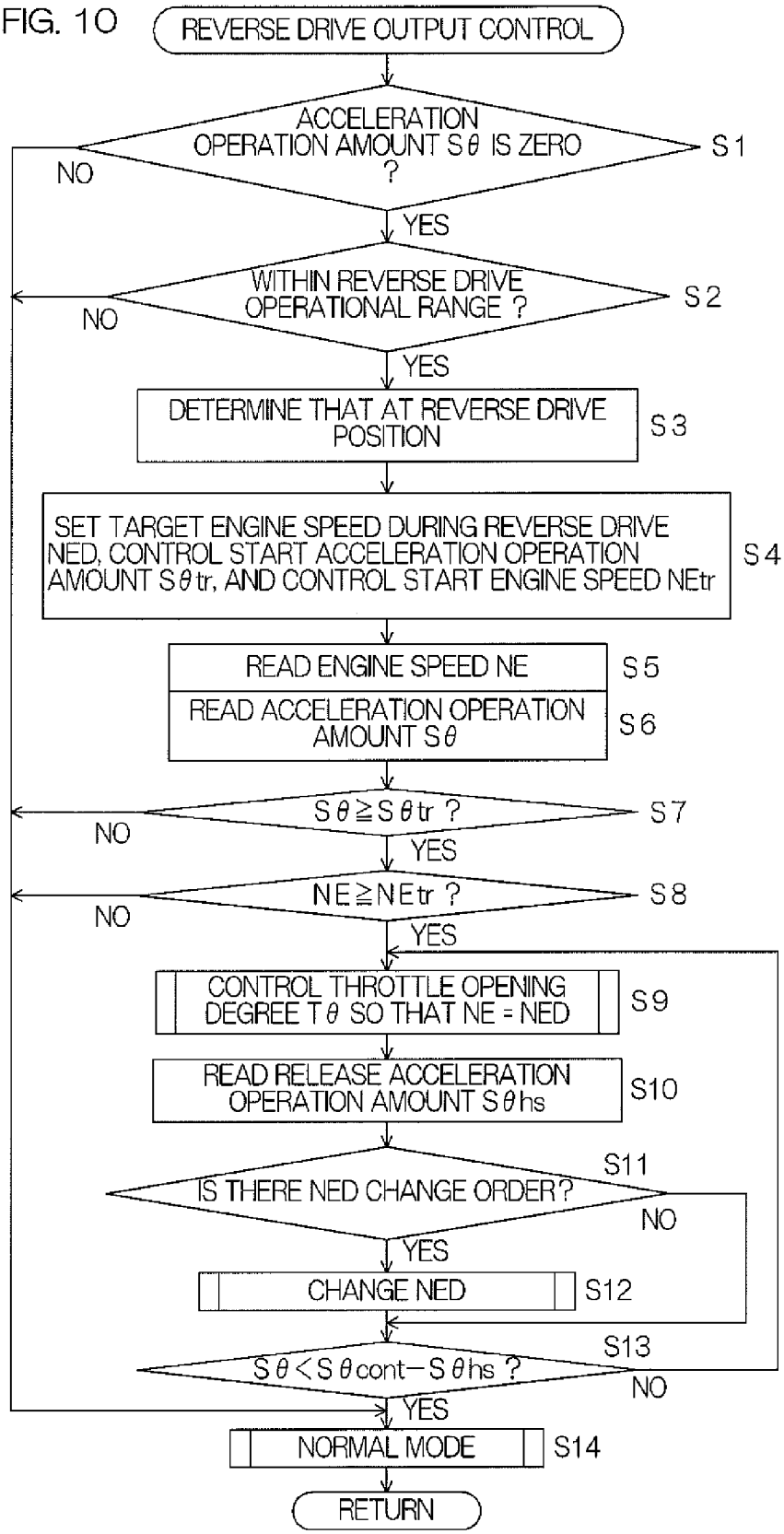
FIG. 10 is a flow chart illustrating characteristic operations of the engine ECU.

FIG. 10 is a flow chart illustrating characteristic operations of the engine ECU 14. The engine ECU 14 determines if the acceleration/shift lever 9 (levers 43R and 43L specifically) is operated to be within the reverse drive operational range based on the output signal from the acceleration position sensor 44. Specifically, the engine ECU 14 determines if the amount of operation of the acceleration/shift lever 9 (amount of acceleration operation) Sθ becomes zero and, thereafter, the acceleration/shift lever 9 is operated to be within the reverse drive operational range (Steps S1 and S2). If YES in both of these determinations, the engine ECU 14 determines that the buckets 28R and 28L (hereinafter, collectively referred to as "bucket 28" as appropriate) are arranged at the reverse drive position (Step S3). In response to this, the engine ECU 14 sets the target engine speed during reverse drive NED (see FIG. 9), control start acceleration operation amount $S\theta_{tr}$ (see FIG. 9), and control start engine speed $NE_{tr}$. The target engine speed during reverse drive NED is a control target value.

The engine ECU 14 controls the engine 13 so that the actual engine speed NE detected by the engine speed sensor 50 becomes equal to the target engine speed. Specifically, the engine ECU 14 drives the throttle actuator 45 to control the throttle opening degree. The control start acceleration operation amount $S\theta_{tr}$ is the acceleration operation amount Sθ when the control under the reverse drive mode is started in which the engine speed NE is made equal to the target engine speed during reverse drive NED. While the acceleration operation amount Sθ is smaller than the control start acceleration operation amount $S\theta_{tr}$, the engine ECU 14 performs control under the normal mode in which the throttle opening degree Tθ is set variably in accordance with the acceleration operation amount Sθ (Step S14). The control start engine speed $NE_{tr}$ is the engine speed when the control under the reverse drive mode is started in which the engine speed NE is made equal to the target engine speed during reverse drive NED. While the engine speed NE is smaller than the control start engine speed $NE_{tr}$, the engine ECU 14 performs control under the normal mode in which the throttle opening degree Tθ is set variably in accordance with the acceleration operation amount Sθ.

The engine ECU 14 reads the actual engine speed NE detected by the engine speed sensor 50 and the actual acceleration operation amount Sθ detected by the acceleration position sensor 44 (Steps S5 and S6). The engine ECU 14 further determines if the acceleration operation amount Sθ is equal to or greater than the control start acceleration operation amount $S\theta_{tr}$ and if the engine speed NE is equal to or greater than the control start engine speed $NE_{tr}$ (Steps S7 and S8). If NO in either of these determinations, the engine ECU 14 performs control under the normal mode (Step S14). If YES in both of these determinations, the engine ECU 14 performs control under the reverse drive mode.

In the reverse drive mode, the engine ECU 14 controls the throttle opening degree Tθ so that the engine speed NE becomes equal to the target engine speed during reverse drive NED (Step S9). The engine ECU 14 also reads the release acceleration operation amount $S\theta_{hs}$ (Step S10). The release acceleration operation amount $S\theta_{hs}$ is a threshold value at which the reverse drive mode is released to return to the control under the normal mode.

The engine ECU 14 further determines if there is a change order to change the target engine speed NED (Step S11). That is, the engine ECU 14 determines if the characteristic change operation unit 15 is operated. If there is an input of a change order for the target engine speed NED, the engine ECU 14 accordingly performs processing to change the target engine speed NED (Step S12). If there is no input of a change order for the target engine speed NED, this processing is omitted.

The engine ECU 14 compares the acceleration operation amount Sθ with the controlled acceleration operation amount $S\theta_{cont}$ (Step S13). More specifically, the magnitude relationship between the acceleration operation amount Sθ and the value obtained by subtracting the release acceleration operation amount $S\theta_{hs}$ from the controlled acceleration operation amount $S\theta_{cont}$ is examined. The controlled acceleration operation amount $S\theta_{cont}$ is a variable used by the engine ECU 14 for internal arithmetic processing in the control under the reverse drive mode. If the acceleration operation amount Sθ is smaller than the value obtained by subtracting the release acceleration operation amount $S\theta_{hs}$ from the controlled acceleration operation amount $S\theta_{cont}$ (YES in Step S13), the engine ECU 14 releases the reverse drive mode and transits to the control under the normal mode (Step S14). Otherwise, the engine ECU 14 repeats the processing from Step S9 to continue the control under the reverse drive mode (Steps S9 to S13).

Figure 11:
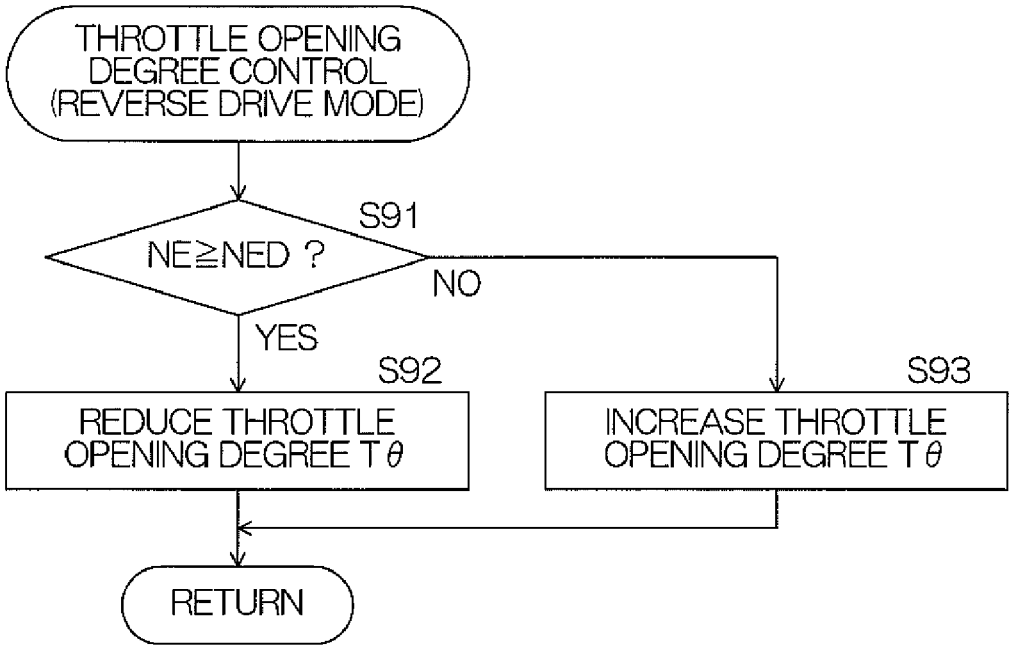
FIG. 11 is a flow chart illustrating the control under the reverse drive mode (Step S9 in FIG. 10).

FIG. 11 is a flow chart illustrating the control under the reverse drive mode (Step S9 in FIG. 10). The engine ECU 14 compares the actual engine speed NE with the target engine speed NED (Step S91). If the actual engine speed NE is equal to or greater than the target engine speed NED (YES in Step S91), the engine ECU 14 reduces the throttle opening degree Tθ (Step S92). On the contrary, if the actual engine speed NE is smaller than the target engine speed NED (NO in Step S91), the engine ECU 14 increases the throttle opening degree Tθ (Step S93). The throttle opening degree Tθ can thus be adjusted so that the actual engine speed NE becomes equal to the target engine speed NED.

Figure 12:
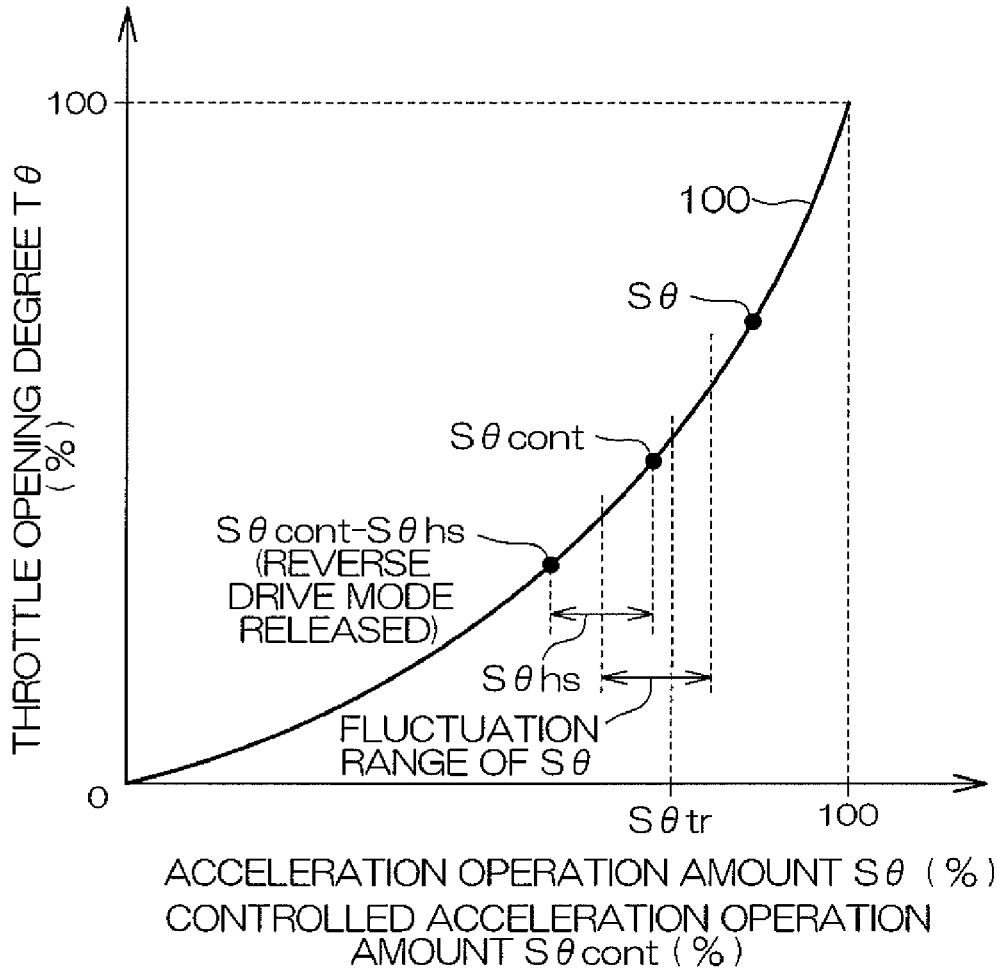
FIG. 12 illustrates details of the control of the throttle opening degree by the engine ECU, the graph showing an example of the characteristics of the throttle opening degree against the amount of acceleration operation.

FIG. 12 illustrates details of the control of the throttle opening degree by the engine ECU 14, the graph showing an example of the characteristics of the throttle opening degree against the amount of acceleration operation. In FIG. 12, the amount of acceleration operation within the reverse drive operational range is expressed in percentage (0 to 100%), and the throttle opening degree is also expressed in percentage (0% (full-close) to 100% (full-open)). The throttle opening degree is 0% (full-close) when the amount of acceleration operation is 0%, while the throttle opening degree is 100% (full-open) when the amount of acceleration operation is 100%. The throttle opening degree is also set to monotonically increase as the amount of acceleration operation increases. This characteristic may be linear or non-linear. In FIG. 12, as an example, a non-linear characteristic is shown by a non-linear throttle opening degree characteristic curve 100.

In the normal mode, the engine ECU 14 applies the actual acceleration operation amount Sθ detected by the acceleration position sensor 44 to the throttle opening degree characteristic curve 100 to set the throttle opening degree Tθ. Accordingly, the throttle opening degree Tθ increases and decreases as the acceleration operation amount Sθ increases and decreases.

In the reverse drive mode, the engine ECU 14 applies the controlled acceleration operation amount $S\theta_{cont}$ obtained through an internal arithmetic operation to the throttle opening degree characteristic curve 100 to set the throttle opening degree Tθ. When the reverse drive mode is initiated (YES in Step S8 in FIG. 10), the engine ECU 14 sets the actual acceleration operation amount Sθ at the time as an initial value of the controlled acceleration operation amount $S\theta_{cont}$. Thereafter, during the control under the reverse drive mode, the engine ECU 14 updates the controlled acceleration operation amount $S\theta_{cont}$ at each control cycle based on the actual engine speed NE and the target engine speed during reverse drive NED. For example, the engine ECU 14 obtains a control amount variation δSθ based on the engine speed deviation ΔNE and the engine speed change rate δNE. The engine speed deviation ΔNE is a deviation of the engine speed NE from the target engine speed during reverse drive NED. The engine speed change rate δNE is the rate of change of the actual engine speed NE and may be, for example, a variation of the engine speed NE between adjacent control cycles. The control amount variation δSθ is a value to be added to the previous controlled acceleration operation amount $S\theta_{cont}$. That is, the controlled acceleration operation amount $S\theta_{cont}(n)$ in the current control cycle "n" ("n" is a natural number representing the number to identify a control cycle) is given by the following formula using the controlled acceleration operation amount $S\theta_{cont}(n-1)$ in the previous control cycle:

$$S\theta_{cont}(n)=S\theta_{cont}(n-1)+\delta S\theta.$$

The control amount variation δSθ may be obtained based on a table including the engine speed deviation ΔNE and the engine speed change rate δNE as variables. The control amount variation δSθ may also be obtained through a functional operation including the engine speed deviation ΔNE and the engine speed change rate δNE as variables. In both of these cases, if NE≧NED (YES in Step S91 in FIG. 11), then δSθ≦0 to result in that the throttle opening degree decreases (Step S92 in FIG. 11). If NE<NED (NO in Step S91), then δSθ>0 to result in that the throttle opening degree increases (Step S93 in FIG. 11). For example, the greater the magnitude |ΔNE| of the engine speed deviation ΔNE and the greater the magnitude |δNE| of the engine speed change rate δNE, the greater the magnitude |δSθ| of the control amount variation δSθ is set.

The controlled acceleration operation amount $S\theta_{cont}$ thus defined is not necessarily equal to the actual acceleration operation amount Sθ. For example, as shown in FIG. 12, the controlled acceleration operation amount $S\theta_{cont}$ may be set variably within a range not including (e.g. smaller than) the actual acceleration operation amount Sθ. It will be appreciated that the acceleration operation amount Sθ, which follows the operation by the operator, may be within or smaller than the fluctuation range of the controlled acceleration operation amount $S\theta_{cont}$.

The reverse drive mode is released if the actual acceleration operation amount Sθ is smaller than the value ($S\theta_{cont}-S\theta_{hs}$) obtained by subtracting the release acceleration operation amount $S\theta_{hs}$ from the controlled acceleration operation amount $S\theta_{cont}$ (Step S13 in FIG. 10). Therefore, as long as $S\theta_{cont}-S\theta_{hs}<S\theta$, the reverse drive mode cannot be released immediately even if the acceleration operation amount Sθ may fall below the control start acceleration operation amount $S\theta_{tr}$. Thus, hysteresis is provided to the conditions for both the initiation and the release of the reverse drive mode, whereby frequent switching between the reverse drive mode and the normal mode can be avoided.

It should be noted that the controlled acceleration operation amount $S\theta_{cont}$ may not necessarily be used for the control of the throttle opening degree according to the comparison between the engine speed NE and the target engine speed during reverse drive NED. For example, if NE≧NED (YES in Step S91 in FIG. 11), the engine ECU 14 may reduce the throttle opening degree Tθ by a predetermined value ΔT (ΔT>0) (Step S92 in FIG. 11). That is, the throttle opening degree Tθ(n) in the current control cycle may be obtained by Tθ(n)=Tθ(n−1)−ΔT using the throttle opening degree Tθ(n−1) in the previous control cycle. On the contrary, if NE<NED (NO in Step S91 in FIG. 11), the engine ECU 14 may increase the throttle opening degree Tθ by a predetermined value ΔT (Step S93 in FIG. 11). That is, the engine ECU 14 may obtain the throttle opening degree Tθ(n) in the current control cycle by Tθ(n)=Tθ(n−1)+ΔT. Also in this approach, the throttle opening degree Tθ can be adjusted so that the actual engine speed NE becomes equal to the target engine speed NED.

The predetermined value ΔT may not be constant. For example, the engine ECU may define the predetermined value ΔT so as to change in accordance with the magnitude of the engine speed deviation ΔNE and/or the magnitude of the engine speed change rate δNE.

Figure 13:
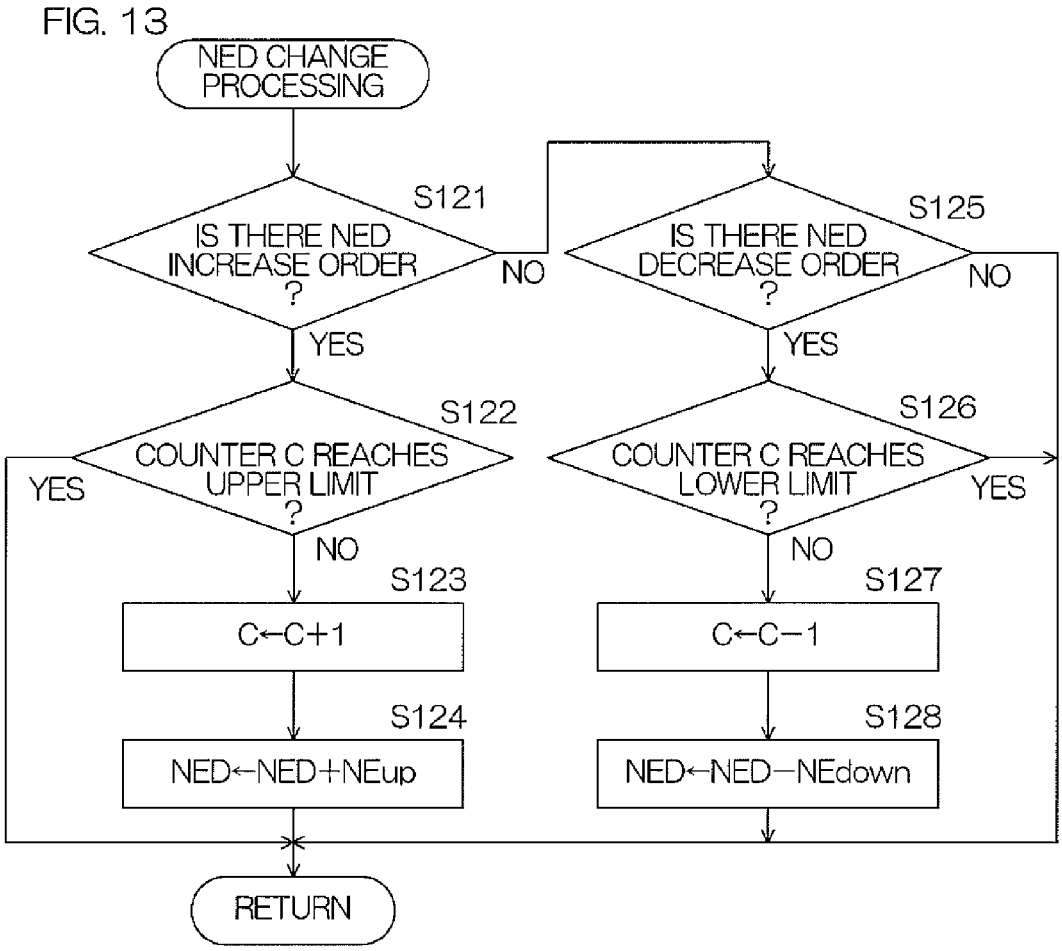
FIG. 13 is a flow chart illustrating the control relating to the change in the target engine speed NED (Step S12 in FIG. 10).

FIG. 13 is a flow chart illustrating the control relating to the change in the target engine speed NED (Step S12 in FIG. 10). The engine ECU 14 determines if there is an input ordering an increase in the target engine speed NED (Step S121). That is, the engine ECU 14 determines if the increase switch 151 is operated to increase the target engine speed NED. If there is an input of an increase order (YES in Step S121), the engine ECU 14 determines if the value of a counter C that represents the step number of the target engine speed NED reaches a predetermined upper limit (Step S122). If the value of the counter C is lower than the upper limit (NO in Step S122), the engine ECU 14 increments the counter C by one (Step S123). Further, the engine ECU 14 adds a predetermined increment NEup (NEup>0) to the current target engine speed NED to set a new target engine speed NED (Step S124). If the value of the counter C has reached the upper limit (YES in Step S122), Steps S123 and S124 are omitted and the target engine speed NED is retained at the previous value.

If there is no input ordering an increase in the target engine speed NED (NO in Step S121), the engine ECU 14 determines if there is an input ordering a decrease in the target engine speed NED (Step S125). That is, the engine ECU 14 determines if the decrease switch 152 is operated to decrease the target engine speed NED. If there is an input of a decrease order (YES in Step S125), the engine ECU 14 determines if the value of the counter C reaches a predetermined lower limit (Step S126). If the value of the counter C is higher than the lower limit (NO in Step S126), the engine ECU 14 decrements the counter C by one (Step S127). Further, the engine ECU 14 subtracts a predetermined decrement $NE_{down}$ ($NE_{down}>0$ and $NE_{up}=NE_{down}$, for example) from the current target engine speed NED to set a new target engine speed NED (Step S128). If the value of the counter C has reached the lower limit (YES in Step S126), Steps S127 and S128 are omitted and the target engine speed NED is retained at the previous value.

As described heretofore, the engine ECU 14 sets the target engine speed NED variably stepwise within a certain range in accordance with the operation of the increase and decrease switches 151 and 152. The target engine speed NED is to be set between an upper target engine speed corresponding to the upper limit of the counter C and a lower target engine speed corresponding to the lower limit of the counter C.

Figure 14A:
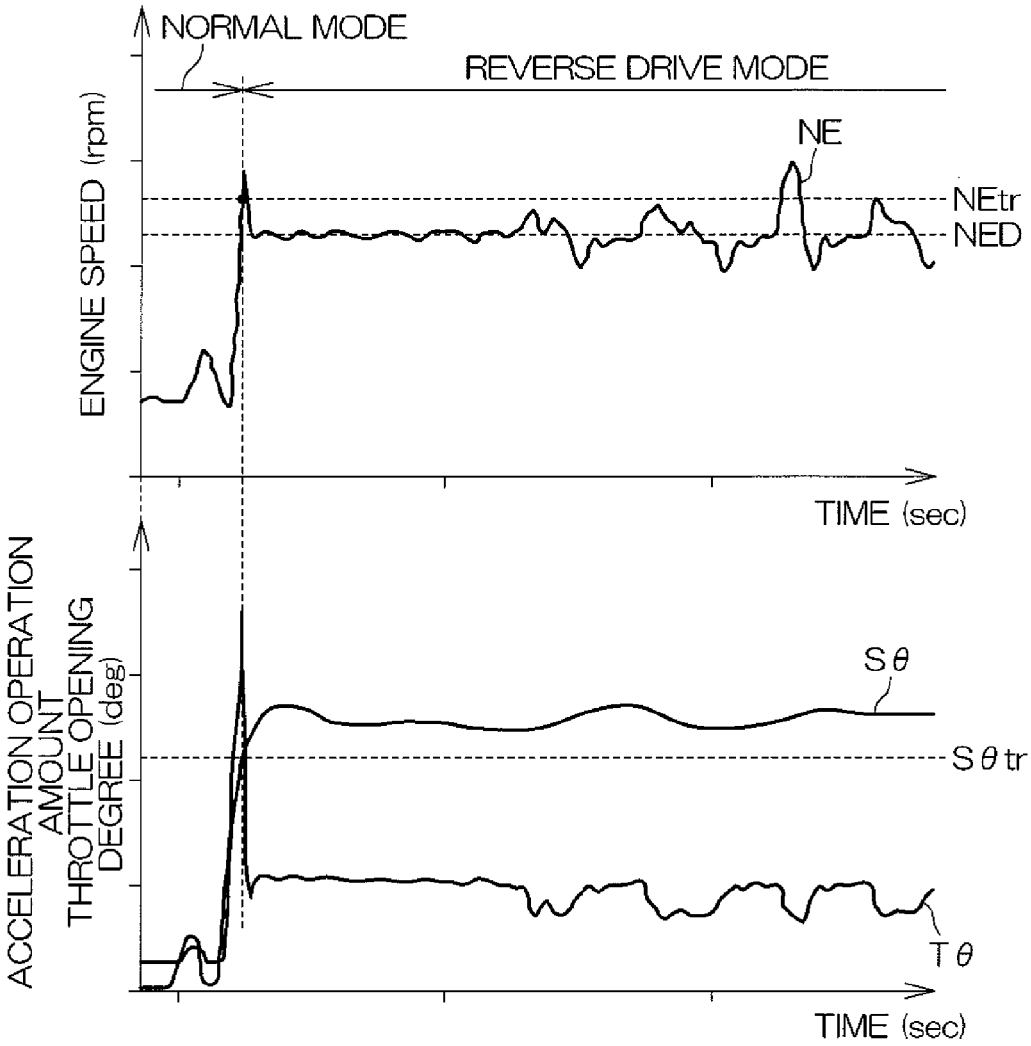
FIG. 14A shows measurement results of the engine speed and so forth in the arrangement according to a preferred embodiment of the present invention.

FIG. 14A shows measurement results of the engine speed and so forth in the arrangement according to a preferred embodiment of the present invention. Specifically, the temporal change in the acceleration operation amount Sθ, throttle opening degree Tθ, and engine speed NE when a reverse drive operation is performed is shown. In addition, the acceleration operation amount Sθ is converted into a value of the throttle opening degree. Until the acceleration operation amount Sθ reaches the control start acceleration operation amount $S\theta_{tr}$ and further the engine speed NE reaches the control start engine speed $NE_{tr}$, the control under the normal mode is performed. Therefore, as the acceleration operation amount Sθ increases, the throttle opening degree Tθ increases and, accordingly, the engine speed NE increases. When the acceleration operation amount Sθ reaches the control start acceleration operation amount $S\theta_{tr}$ and the engine speed NE reaches the control start engine speed $NE_{tr}$, the control under the reverse drive mode is initiated. This controls the throttle opening degree Tθ so that the engine speed NE becomes equal to the target engine speed NED. When the load on the engine 13 fluctuates under the influence of air drawing, the engine speed NE is also to fluctuate accordingly. Such fluctuation in the engine speed NE can be prevented and minimized the variable control of the throttle opening degree Tθ.

Figure 14B:
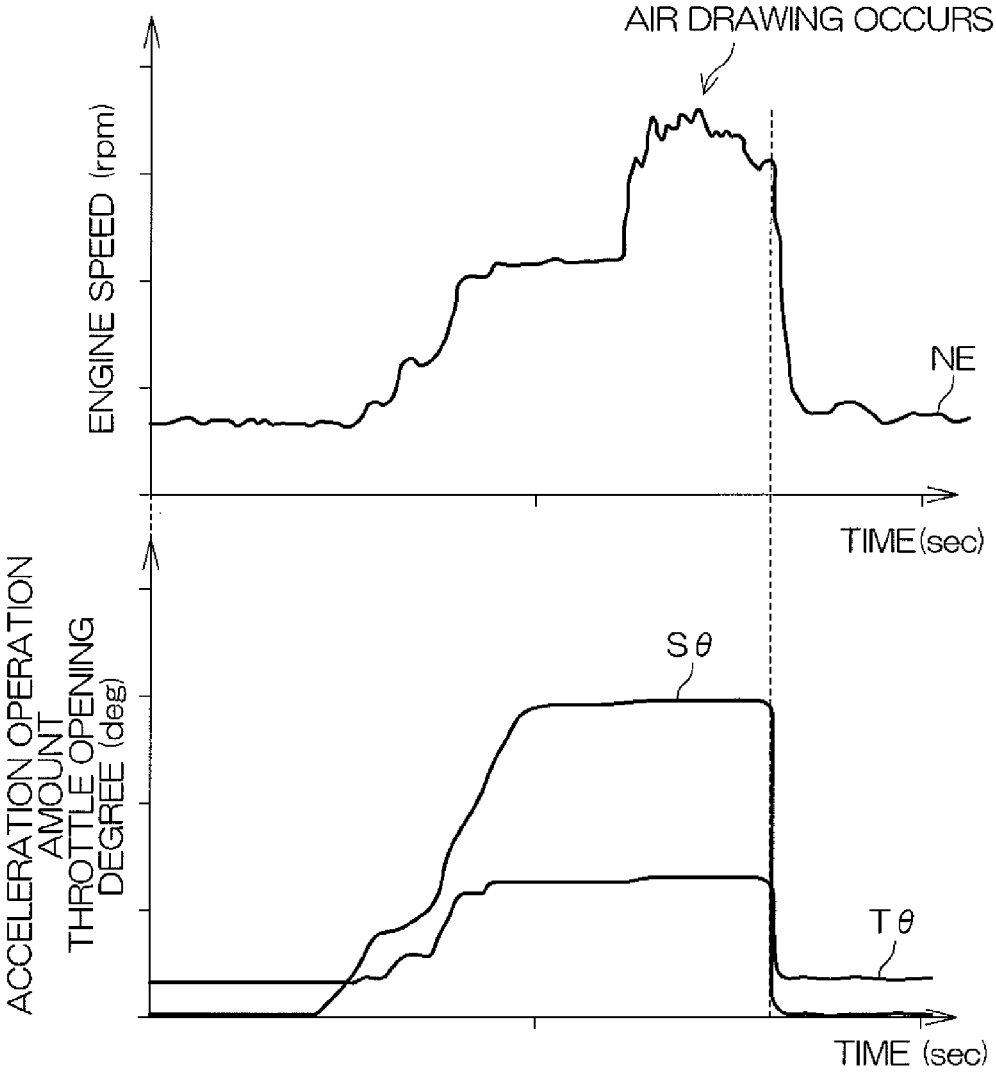
FIG. 14B shows measurement results in a comparative example in which not the engine speed but the throttle opening degree is controlled to be kept constant during a reverse drive.

FIG. 14B shows measurement results in a comparative example in which not the engine speed NE but the throttle opening degree Tθ is controlled to be kept constant during a reverse drive. Since the load on the engine 13 decreases at once with the occurrence of air drawing, the engine speed NE increases rapidly. This causes the air drawing to become more severe. Reducing the throttle opening degree Tθ to eliminate the air drawing results in a reduction in the engine speed NE. However, eliminating the air drawing causes the load of water to be placed on the impeller 24 (see FIGS. 6 and 7) at once, and thereby the load on the engine 13 increases rapidly. This causes a rapid decrease in the engine speed NE, resulting in an insufficient propulsive force.

Figure 14C:
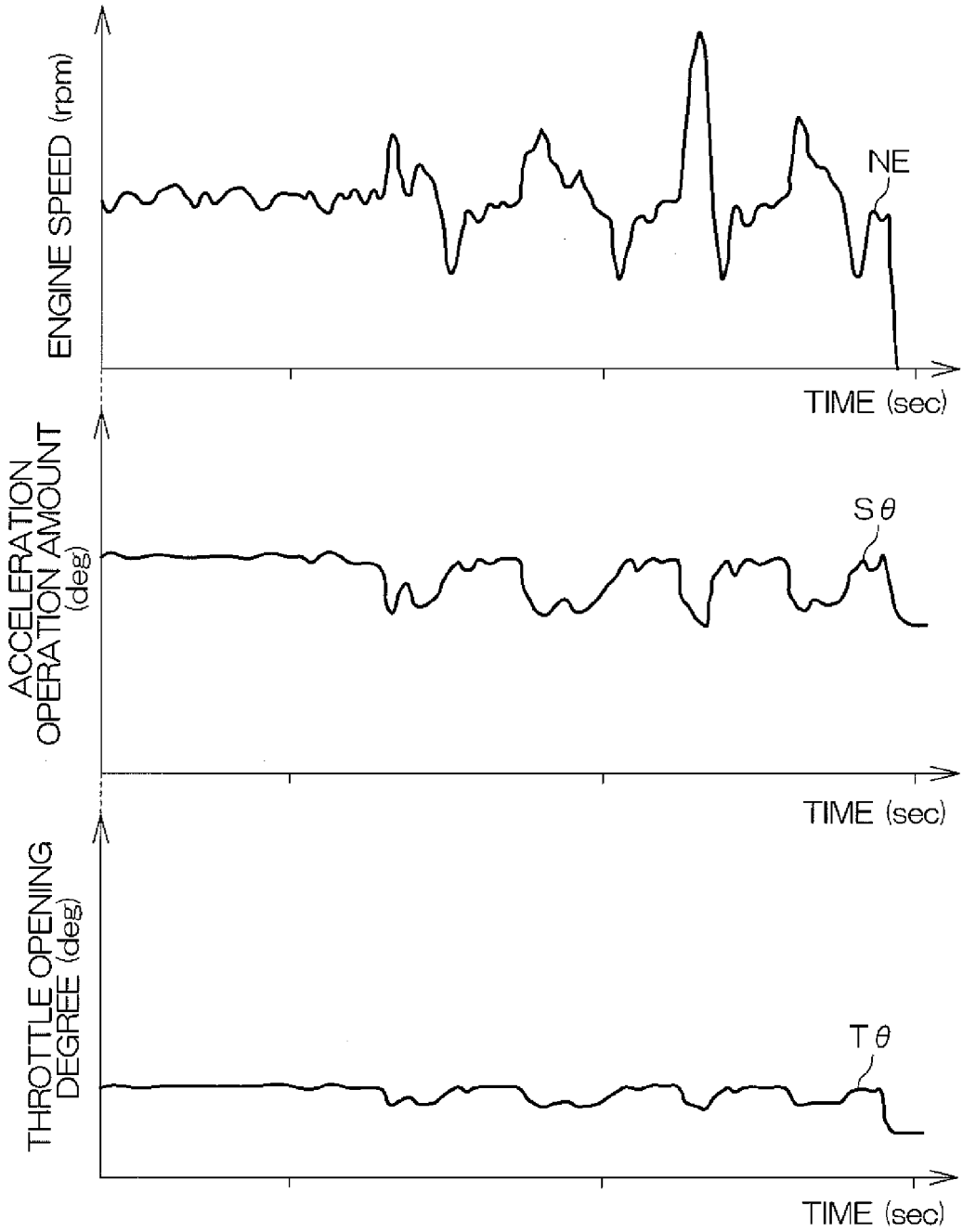
FIG. 14C shows measurement results in the case (comparative example) where air drawing is eliminated with an acceleration operation by a skilled marine vessel maneuvering operator during a reverse drive.

FIG. 14C shows measurement results in the case (comparative example) where air drawing is eliminated with an acceleration operation by a skilled marine vessel maneuvering operator during a reverse drive. When air drawing occurs, the marine vessel maneuvering operator reduces the acceleration operation amount Sθ. When the air drawing is eliminated and the load on the engine 13 increases, the marine vessel maneuvering operator increases the acceleration operation amount Sθ. Repeating these operations in good timing allows a propulsive force necessary for reverse drive to be acquired. However, as shown in FIG. 14C, it is necessary to perform acceleration operations frequently in good timing and the engine speed NE still fluctuates wildly. That is, since it is difficult to avoid overshoot and undershoot of the engine speed NE, it is impossible to acquire a stable propulsive force.

Figure 15:
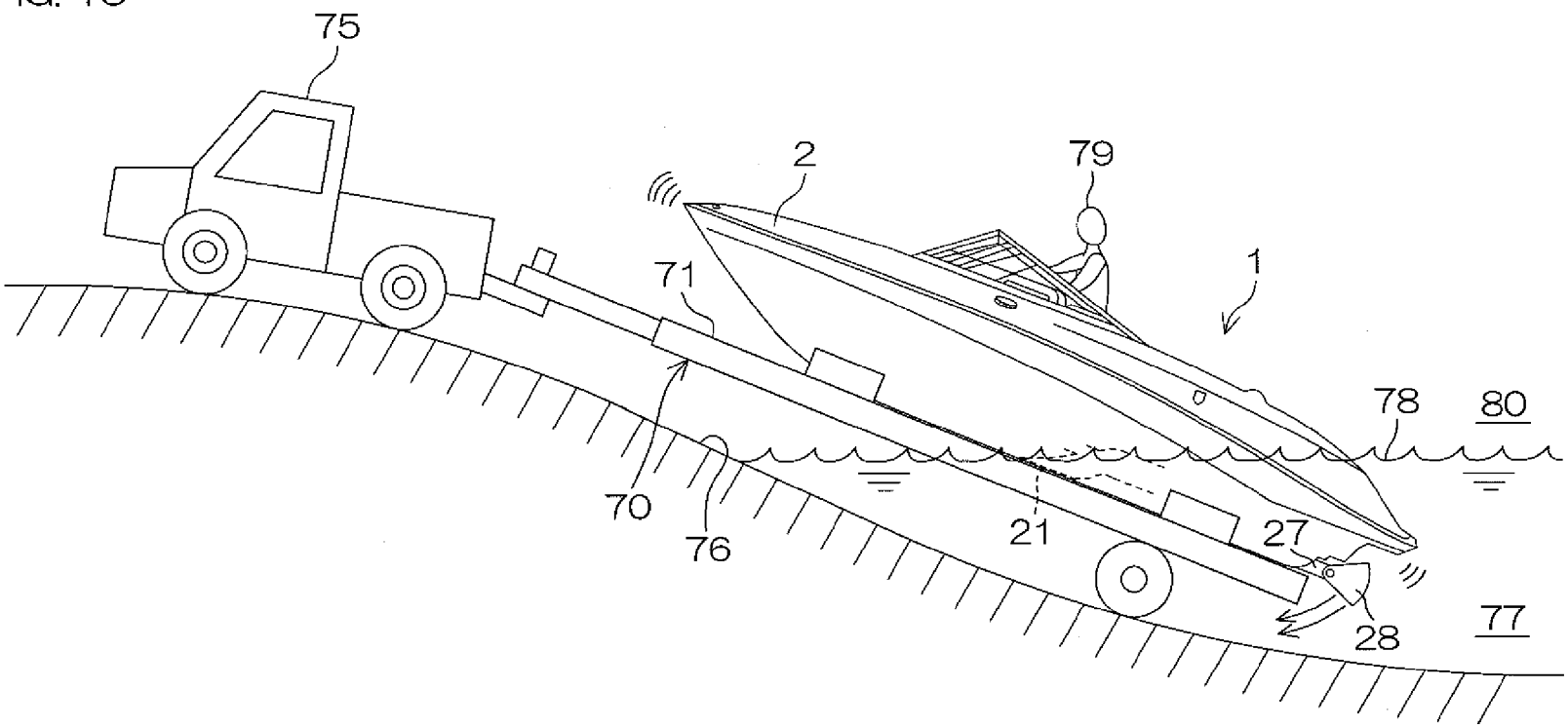
FIG. 15 schematically illustrates backward launching by which the water jet propulsion watercraft is launched backward.

FIG. 15 schematically illustrates backward launching by which the water jet propulsion watercraft 1 is launched backward. The water jet propulsion watercraft 1 is loaded on the back 71 of a trailer 70. The trailer 70 is arranged to be towed by a vehicle 75 including a towing mechanism. During backward launching, the user operates the vehicle 75 to drive the trailer 70 in reverse from the waterfront 76 into the water 77. This causes the rear portion of the hull 2 of the water jet propulsion watercraft 1 to get into the water 77. In this case, the intake 21 lies in the water near the water surface 78 and, if the water surface 78 is disturbed, can be exposed into the air for a moment.

In this state, the marine vessel maneuvering operator 79 of the water jet propulsion watercraft 1 operates the acceleration/shift lever 9 to be within the reverse drive operational range. This causes the bucket 28 to cover the ejection port 52 of the deflector 27 (see FIGS. 6 and 7). The marine vessel maneuvering operator further increases the amount of acceleration operation to thereby increase the output of the engine 13. With this operation, the jet propulsion device 3 takes in surrounding water through the intake 21 and ejects the water. The ejected water is reversed by the bucket 28 to be directed forward with respect to the hull 2. This provides a propulsive force in the reverse drive direction to the hull 2.

Meanwhile, since the forward ejected water flow contains air bubbles, and further disturbs the water surface 78 near the hull 2, the intake 21 can be exposed into the air 80. Therefore, the jet propulsion device 3 may draw air therein to undergo air drawing.

In this preferred embodiment, while the acceleration operation amount Sθ is equal to or greater than a certain value and if the engine speed NE is equal to or greater than the control start engine speed $NE_{tr}$, the control under the reverse drive mode is performed and the engine speed NE is controlled to be constant, as described above. As a result, when air drawing occurs, the throttle opening degree Tθ is reduced rapidly, while the air drawing is eliminated, the throttle opening degree Tθ is increased rapidly. This allows the reduction in the propulsive force due to air drawing to be minimized. Therefore, even a non-skilled marine vessel maneuvering operator can perform backward launching smoothly to launch the water jet propulsion watercraft 1 quickly.

During not only backward launching but also a reverse drive, air bubbles contained in the water flow can reach the intake 21 to cause air drawing. Even in this case, a stable propulsive force can be acquired with the application of the control under the reverse drive mode. This facilitates the reverse drive maneuvering operation.

The marine vessel maneuvering operator can operate the characteristic change operation unit 15 to adjust the target engine speed during reverse drive NED based on the environment of usage such as the actual load (e.g., number of crews) and/or conditions (e.g., size of the slope on the waterfront). This provides a further stable propulsive force during a reverse drive.

Although the preferred embodiments of the present invention have been described above, the present invention may be embodied in another form. For example, although in the preferred embodiments described above preferably is a water jet propulsion watercraft 1 of a jet boat type, the present invention is also applicable to other types of water jet propulsion watercrafts such as personal water crafts.

Although the preferred embodiments above describe the case where in the reverse drive mode, making the engine speed NE equal to the preset target engine speed NED is a control target, another arrangement may be applied. For example, an upper engine speed limit and a lower engine speed limit during a reverse drive may be predefined and the engine speed NE may be controlled to be within the speed range between the upper and lower engine speed limits.

Although the preferred embodiments above describe the case where the characteristic change operation unit 15 includes the increase switch 151 and decrease switch 152, another arrangement may be applied. For example, an arrangement in which the target engine speed NED during a reverse drive is changed by the rotational operation of a rotary knob may be applied to the characteristic change operation unit 15. The target engine speed NED may not necessarily be changed stepwise, but may be changed continuously in accordance with the operation of the characteristic change operation unit 15.

The following shows non-limiting examples of the relationships between the components described in the SUMMARY OF THE INVENTION and the components described in the preferred embodiments above.

Hull: Hull 2

Jet propulsion device: Jet propulsion devices 3R and 3L

Ejection port: Ejection ports 52R and 52L

Reversing member: Buckets 28R and 28L

Operation unit: Acceleration/shift lever 9

Internal combustion engine: Engines 13R and 13L

Control unit: Engine ECUs 14R and 14L

Acceleration operation member: Acceleration/shift lever 9

Characteristic change operation unit: Characteristic change operation unit 15

While preferred embodiments of the present invention have been described above, it is to be understood that variations and modifications will be apparent to those skilled in the art without departing the scope of the present invention. The scope of the present invention, therefore, is to be understood solely by the following claims.

The present application corresponds to Japanese Patent Application No. 2010-58036 filed in the Japan Patent Office on Mar. 15, 2010, and the entire disclosure of the application is incorporated herein by reference.

What is claimed is:

1. A marine vessel comprising:

a hull;

a jet propulsion device arranged to take in water through an intake port and eject the water through an ejection port rearward with respect to the hull, the ejection port being arranged posterior to the intake port;

a reversing member arranged to be movable between a forward drive position and a reverse drive position, the reversing member arranged to, when placed at the reverse drive position, reverse the direction of the water ejected from the jet propulsion device forward with respect to the hull;

an operation unit arranged to be operated by a marine vessel maneuvering operator to locate the reversing member at the forward drive position or the reverse drive position;

an internal combustion engine arranged to drive the jet propulsion device;

a control unit arranged and programmed to operate in a reverse drive mode in which, when the reversing member is located at the reverse drive position by the operation unit, the control unit controls the internal combustion engine to operate within a predetermined speed range; and an acceleration operation member arranged to be operated by the marine vessel maneuvering operator to specify a throttle opening degree of the internal combustion engine, wherein the control unit is further arranged and programmed to, when the reversing member is located at the reverse drive position, control the internal combustion engine in accordance with the throttle opening degree that corresponds to the amount of operation of the acceleration operation member if the amount of operation is smaller than a predetermined value or if a speed of the internal combustion engine is smaller than the predetermined speed range, and to start control of the internal combustion engine under the reverse drive mode if the amount of operation of the acceleration operation member is equal to or greater than the predetermined value and the speed of the internal combustion engine is equal to or greater than the predetermined speed range.

2. The marine vessel according to claim 1, wherein the control unit is further arranged and programmed to operate in a normal mode in which the control unit controls the internal combustion engine in accordance with the throttle opening degree that corresponds to the amount of operation of the acceleration operation member.

3. The marine vessel according to claim 1, further comprising a characteristic change operation unit arranged to be operated by the marine vessel maneuvering operator to change the predetermined speed range, wherein the control unit is arranged and programmed to change the predetermined speed range in response to the operation of the characteristic change operation unit.

4. A marine vessel comprising:

a hull;

a jet propulsion device arranged to take in water through an intake port and eject the water through an ejection port rearward with respect to the hull, the ejection port being arranged posterior to the intake port;

a reversing member arranged to be movable between a forward drive position and a reverse drive position, the reversing member arranged to, when placed at the reverse drive position, reverse the direction of the water ejected from the jet propulsion device forward with respect to the hull;

an operation unit arranged to be operated by a marine vessel maneuvering operator to locate the reversing member at the forward drive position or the reverse drive position;

an internal combustion engine arranged to drive the jet propulsion device;

a control unit arranged and programmed to operate in a reverse drive mode in which, when the reversing member is located at the reverse drive position by the operation unit, the control unit controls the internal combustion engine to operate within a predetermined speed range; and an acceleration operation member arranged to be operated by the marine vessel maneuvering operator to specify a throttle opening degree of the internal combustion engine, wherein the control unit is further arranged and programmed to operate in a normal mode in which the control unit controls the internal combustion engine in accordance with the throttle opening degree that corresponds to the amount of operation of the acceleration operation member;

the control unit is arranged and programmed to calculate a target throttle opening degree at which the internal combustion engine operates within the predetermined speed range in the reverse drive mode and to control the internal combustion engine in accordance with the target throttle opening degree, and the control unit is further arranged and programmed to calculate a controlled acceleration operation value that corresponds to the target throttle opening degree and to release the reverse drive mode when the amount of operation of the acceleration operation member becomes smaller than the controlled acceleration operation value by a predetermined value or more.

5. The marine vessel according to claim 4, wherein the control unit is programmed to calculate the controlled acceleration operation value by adding a control amount variation based on an engine speed deviation from a target engine speed and an engine speed change rate to an actual acceleration operation amount.

* * * * *